US005223845A

United States Patent [19]

Eguchi

[11] Patent Number: 5,223,845

[45] Date of Patent: Jun. 29, 1993

[54] ARRAY ANTENNA AND STABILIZED ANTENNA SYSTEM

[75] Inventor: Kouichi Eguchi, Tokyo, Japan

[73] Assignee: Japan Radio Co., Ltd., Tokyo, Japan

[21] Appl. No.: 774,598

[22] Filed: Oct. 10, 1991

[30] Foreign Application Priority Data

Mar. 6, 1991 [JP] Japan ..... 3-40297

[51] Int. Cl.[5] ..... H01Q 3/00; H01Q 3/22

[52] U.S. Cl. ..... 342/359; 342/371; 343/757

[58] Field of Search ..... 342/75, 77, 352, 354, 342/359, 372, 371; 343/757, 765

[56] References Cited

U.S. PATENT DOCUMENTS

| | | | |
|---|---|---|---|
| 4,334,226 | 6/1982 | Eguchi et al. | 342/359 |
| 4,621,266 | 11/1986 | Le Gall | 342/359 |
| 4,649,393 | 3/1987 | Rittenbach | 342/371 |
| 4,823,134 | 4/1989 | James et al. | 342/359 |

FOREIGN PATENT DOCUMENTS

| | | | |
|---|---|---|---|
| 51-115757 | 11/1974 | Japan . | |
| 51-110950 | 9/1976 | Japan . | |
| 0083479 | 3/1990 | Japan | 343/757 |

OTHER PUBLICATIONS

Vandenkerckhove, "MAROTS—A European Satellite For Maritime Communication" World Telecommunication Forum Technical Symposium, Switzerland (Oct. 6-8, 1975).

Control Method Of 2-Axis Az-El Antenna Mount Hironori Yuki, et al. 1983.

Development Of A Compact Antenna System For The INMARSAT Standard-B SES In Maritime Satellite Communications Takayasu Shiokawa, et al. Aug. 31, 1984.

Phased Array Antenna For MARISAT Communications E. Folke Bolinder, Dec. 1978.

Inmarsat-M System Definition Manual (issue 2).

ETS-V Open Experiment Implementation Review Issued by Ministry of Japanese Posts and Telecommunications, Communications Policy Bureau Jan. 22, 1988.

Airborne Array Antennas For Aeronautical Satellite Communication Masayuki Yasunaga, et al. 1986.

*Primary Examiner*—Gregory C. Issing

*Attorney, Agent, or Firm*—Koda & Androlia

[57] ABSTRACT

An array antenna can control directions of beams by phase-shifting signals received and/or transmitted by a plurality of antenna elements. When the antenna elements are arranged two-dimensionally, sidelobes and beamwidth are determined according a distance between two adjacent antenna element columns. The distance between the adjacent columns can be reduced by arranging the antenna elements in a staggered manner, thereby suppressing the sidelobes, and enlarging the width of beams around an XEL axis. A stabilized antenna system controls the direction of the array antenna and beam directivity by compensating for inclination of a moving platform, so that the array antenna can always track a satellite reliably.

9 Claims, 20 Drawing Sheets

ELEMENT DIAMETER: APPROX. $\frac{\lambda}{2}$

HORIZONTAL DISTANCE BETWEEN ELEMENTS: $dx<0.6\lambda$

DISTANCE BETWEEN ELEMENTS: $d=\{(dx)^2+(dy)^2\}^{\frac{1}{2}}>\frac{\lambda}{2}$ WAVELENGTH: $\lambda$

ARRAY ANTENNA AND STABILIZED ANTENNA SYSTEM

BACKGROUND OF THE INVENTION

1. Field of the Invention

This invention relates to a stabilized antenna system on a moving platform like a ship to be used for satellite communications or for receiving the satellite broadcasting signal, and more particularly to a stabilized antenna system having a function to stabilize an array antenna against roll and pitch of such moving platform.

2. Description of the Related Art

Heretofore, directional antennas such as parabolic reflector antennas have been used for satellite communications. Historically, the maritime satellite communications was started in 1976 by using the MARISAT system. It was handed over in 1982 to the internationally organized INMARSAT system and has been in operation since then.

According to the technical requirements document for the standard-A ship earth station in the present INMARSAT system as of June 1987, the ship earth station should have G/T of −4 dBK at least. To meet this requirement, a parabolic reflector antenna should be about 0.8 meters (or more) in diameter, for example.

Further, a radome is necessary to make the parabolic reflector antenna resistant to rainwater and rough weather. Such radome should be about 1.2 meters in diameter for the parabolic reflector antenna of 0.8 meters in diameter. The radome is a dome-shaped housing made of material which can pass the microwaves (of approximately 1.5 GHz) for the satellite communications. Generally, FRP (Fibre Reinforced Plastics) is used for the radome. The radome is usually mounted on a radome base and the radome base has an access hutch to facilitate maintenance and repair work.

A stabilized antenna system has been known as a system described as above. This antenna system has a stabilization function as well as a satellite tracking function.

The antenna should be steered so that the antenna system installed on a moving platform such as a ship can well receive radio waves from the satellite. To track the satellite under roll and pitch motions, the antenna should be stabilized by mechanical or electronical means. A variety of technologies have been developed to steer the antenna to track the satellite under roll and pitch.

Sometimes the parabolic reflector antenna is steered by an antenna mount with three mechanical axes, such as an AZ-EL-XEL (Azimuth-Elevation-Cross Elevation) mount, for example.

An AZ axis is for steering the antenna in azimuth. An EL axis is for steering the antenna in elevation. Further, an XEL axis is perpendicular to the EL axis.

In the 3-axis antenna mount, when all the three axes are mechanical, the entire antenna mount tends to become heavy, large and complicated. To overcome such inconvenience, an antenna mount having two mechanical axes has been proposed.

Examples of such two-axis antenna mounts, AZ-EL mounts, are disclosed in "Control Method of 2-Axis Az-El Antenna Mount," by Yuki, et al., Electronic Communications Society, SANE83-53, page 1-6, and "Development of a Compact Antenna System for the INMARSAT standard B SES in Maritime Satellite Communications," by Shiokawa, et al., Electronic Communications Society, SANE 84-19, page 17-24.

However, an AZ-EL mount has a problem of a singular point in the direction for the zenith.

To cope with such singular point, each axis of the AZ-EL mount should be controlled by a highly sophisticated wideband servo control means. Such a wideband servo control means tends to be costly. Even when these sophisticated measures are taken, there are data showing that a tracking error of about 10° exists in the vicinity of the singular point.

To overcome the foregoing inconveniences, there is currently known an antenna system which steers the beam electronically. Such electronic steering is realized by a so-called phased array antenna.

An antenna system with phased array antenna is disclosed in "Phased Array Antenna for MARISAT Communications," Folkebolinder, Microwave Journal, 1978, 12, pp 39–42. This system includes an AZ axis for mechanical steering in azimuth and two planar array antennas including a plurality of antenna elements arranged on two panels and variable phase shifters for controlling the beam directivity thereof. (For the simplicity, variable phase shifter may be described as "phase shifter".)

Specifically, the phase shifters are connected to the individual antenna elements. The phase shifters control the amount of phase of signals related to the antenna elements. By controlling the amount of phase shift, beam directivity of the antenna can be varied as desired.

However, even when the electronic steering is performed as described above, the phase shifters should be mounted for the respective antenna elements one to one basis, so that the overall antenna will become large, complicated and expensive. Therefore, application of the foregoing antenna system has been somewhat limited.

Antenna systems are disclosed in Japanese Patent Laid Open Publication No. SHO 51-110950 to cope with the above-described inconveniences. The publication describes a plurality of array antennas to be installed on ships for the maritime satellite communications. One of the antenna systems comprises AZ and EL axes for mechanical steering to control beam patterns by combining outputs from a plurality of array antennas. This system is simplified, small, less expensive, and easy to maintain.

A further example of the antenna system allowing electronic steering is disclosed in the co-pending "Method of Antenna Stabilization and Stabilized Antenna System", Japanese Patent Application No. HEI 2-339317. The citation relates to an X1-Y-X2 antenna mount without AZ and EL axes. The X1 and Y axes are mechanically steered, and the X2 axis is electronically steered. Therefore, the whole antenna system is simplified and less expensive.

However, in any of the above-cited examples, the array antennas have antenna elements arranged in the shape of lattice. In the so-called AZ-EL-XEL mount, if the AZ and El axes were mechanical and if the XEL (cross-elevation) axis were electronical, there would be an inconvenience that the phase shifters would have to control a large angular area, because a horizontal distance between the adjacent antenna elements would be relatively large as described later.

FIG. 18 of the accompanying drawings shows an array antenna with a (2, 2, 2) element arrangement.

As shown in FIG. 18, antenna elements 10 are arranged in the shape of lattice on a base plate 12. The horizontal distance between the two adjacent antenna elements 10 is expressed by dx, and the vertical distance is expressed by dy. Theoretically, a diameter of each antenna element is about $\lambda/2$ ($\lambda$: wavelength). In the illustrated arrangement, both dx and dy should be $\lambda/2$ or more to prevent overlapping of the antenna elements 10.

FIG. 19 shows the configuration of the AZ-EL-XEL mount, which has AZ, EL and XEL axes. The AZ axis is steered to adjust the azimuth, and the EL axis is steered to adjust the elevation angle. The XEL axis is steered to adjust the cross-elevational angle in a plane parallel to the EL axis. If the AZ and EL axes were mechanically steered to angularly move the array antenna 10 and if signals received by the antenna elements 10 on the array antenna 12 were phase-shifted by a phase shifter to steer the beams around the XEL axis perpendicular to the EL axis, an AZ-EL-XEL mount which includes an electronically controlled XEL axis could be realized. For example, if the array antenna 12 were lengthwisely mounted in parallel to the EL axis and if one variable phase shifter were disposed for each pair of vertically aligned antenna elements, the antenna beam could be steered for the XEL axis by giving the phase shift commands to the phase shifters. In other words, the XEL axis could be electronically steered.

FIG. 20 shows radiation patterns of the array antenna 12 having the mechanically steered AZ-axis and EL-axis, and the electronical XEL-axis of FIG. 18.

In FIG. 20, the radiation pattern A0 is obtained when phase shift of the phase shifter is 0° for each antenna element 10. The radiation pattern A1 is obtained when phase shift are plus/minus 90° for the two antenna elements in the left/right columns, respectively and is 0° for the two central antenna elements.

In these radiation patterns A0 and A1, a first sidelobe has peaks at positions deviating about plus/minus 45° from the main lobe (beam). The peak of first sidelobe related to the radiation pattern A0 is about −13 dB for the peak of the main lobe, and the first peak of the first sidelobe related to the radiation pattern A1 is about −10 dB for the peak of the main lobe.

When such remarkable sidelobes appear, the antenna system decreases its efficiency and radiates radio waves in unnecessary directions, thereby possibly interfering other communication systems.

If an array antenna of the conventional lattice arrangement such as in FIG. 18 were adopted for an example antenna in the electronic XEL axis and the electronic XEL axis were inclined, the remarkable sidelobes should appear. In FIG. 18, the larger the phase shift of the phase shifter, the more remarkable sidelobes occur. In other words, the more the electronic XEL axis is inclined, the more remarkably the sidelobes occur. For example, minimum requirements of the roll angle and pitch angle for the INMARSAT-M Ship Earth Station are plus/minus 25° and plus/minus 15°, respectively. (Reference will be made to "INMARSAT-M SYSTEM DEFINITION MANUAL (issue 2) MODULE 2 3.6.2.2 Recommended Environmental Conditions for Maritime Class MESs.) If the ship inclines together with the antenna system when a satellite as a tracking target exists in the direction along the bow and stern of the ship and near the zenith, the XEL axis should be inclined most extensively. In the above-described case, the antenna beam should cover at least a range of about plus/minus 25 degrees around the XEL axis. Unfortunately, if an antenna beam of the conventional lattice arrangement array antenna were inclined to cover the range of plus/minus 25 degrees around the XEL axis, the disadvantage of remarkable sidelobes would appear.

SUMMARY OF THE INVENTION

With the foregoing problems in view, it is therefore an object of this invention to provide a stabilized antenna system which can track satellite reliably by using an array antenna which is relatively free from sidelobes and is realized less expensively.

According to this invention, an array antenna comprises at least an antenna, an elevation axis, an azimuth axis and variable phase shifters. The elevation axis supports the antenna to move the antenna angulary to the elevation axis, and the azimuth axis supports both the antenna and the elevation axis to move the antenna angulary to the azimuth axis. The array antenna of this invention includes at least two mechanical axis.

The antenna has a plurality of antenna elements. The antenna elements are aligned in N columns (N=odd number being at least 3) in parallel to the elevation axis. This invention features that the antenna elements are arranged in a staggered manner. Specifically, antenna elements in adjacent columns are arranged vertically alternately. A variable phase shifter is provided for each N−1 column at least to phase-shift the signals received and/or transmitted by the antenna elements in the corresponding column. Therefore, beams can be steered.

The antenna elements can be arranged rather densely in direction parallel to EL axis according to this invention due to the staggered arrangement. Generally, the antenna elements should be geometrically arranged with predetermined distances between them to reduce mutual interferences of the adjacent antenna elements. With this invention, the antenna elements are slantingly adjacent to one another, thereby reducing the distances between the adjacent columns.

The shorter the distances between the columns, the more effectively the sidelobes can be suppressed in the radiation patterns and the larger the beam width. Further, since the distances between the columns are shorter, beam can be achieved by controlling the variable phase shifters slightly compared with the conventional lattice arrangement array antenna system. The phase shift $\phi i$ of the variable phase shifter is expressed as:

$$\phi i = (dx \cdot \sin \Theta i \cdot 2\pi)/\lambda [\text{rad}] \quad (1)$$

where $\Theta i$ indicates beam inclination, $\lambda$: wavelength, and dx: distance between two adjacent columns. From Equation (1), the phase shift $\phi i$ is reduced as dx is small when the beam inclination $\Theta i$ is fixed.

A stabilized antenna system of this invention includes the above-mentioned array antenna and following means.

Satellite data input means is necessary to know an elevation angle and azimuth of a satellite. Inclination detecting means is used to detect the amount of inclination of the moving platform.

Motors are used to move the azimuth axis and elevation axis, respectively.

The antenna system further includes means for controlling the azimuth axis driving motor, means for controlling the elevation axis driving motor, and means for controlling the phase shifters. The azimuth axis motor controlling means controls the azimuth axis motor of an angle to move according to the relative azimuth (i.e. bearing) of the satellite, the elevation axis motor controlling means controls the elevation axis motor of an angle to move according to the elevation angle and relative azimuth of the satellite and the amount of inclination (i.e. roll and pitch) of the moving platform. The phase shifter control means determines the phase shifts of the phase shifters based on the elevation angle, bearing of the satellite, amount of inclination of the moving platform, and controls the variable phase shifters. The former two control means are used to steer the mechanical axes, and the phase shifters are for steering the electronic XEL axis.

With this arrangement, the stabilized antenna system can track the satellite under roll, pitch and turn of the moving platform.

The following means are used to improve operation of the array antenna of this invention. To suppress sidelobes, the number of antenna elements in each column is designed so that the number of elements in central column is more than those of other columns and the number of elements in the other columns is less than those of inner columns. Therefore, sidelobes can be further suppressed compared with those of the antenna with conventional lattice arrangement.

To facilitate inspection and maintenance, a radome base should have an access hutch which is wide enough to get access to the antenna. To widen the access hutch, the antenna, elevation axis and azimuth axis are supported at a position deviating from the center of radome base.

The inclination detecting means preferably includes two-axis inclination detecting means. The two-axis inclination detecting means can be mounted rotatably around the azimuth axis. The two-axis inclination detecting means detects an inclination around the elevation axis and an another inclination around a hypothetical axis perpendicular to the elevation axis. Thereby arithmetic operation related to the antenna stabilization is simplified.

The antenna system of this invention intends to control the antenna direction and the beam direction as the final objects. The antenna changes its direction as the azimuth axis is steered. As described above, the azimuth axis is steered according to the relative azimuth of the satellite. With the present invention, stabilization is performed mainly by controlling the elevation axis (by controlling the elevation axis motor) and of the electronic cross-elevation axis (by controlling the amount of phase shift). For this purpose, the antenna system of this invention needs the inclination around the elevation axis and the inclination around the hypothetical axis in the plane perpendicular to the elevation axis.

These inclinations are obtained by resolving the outputs of the inclination detecting means. If the inclination detecting means is fixedly mounted on the moving platform and is inclined together with the moving platform, the outputs of the inclination detecting means cannot be easily resolved into the two components described above. Generally, the detecting means is mounted on an XY-plane and the bow direction of the moving platform is set on the X axis. The inclination detecting means detects the inclinations around the X-axis (i.e. roll) and around the Y-axis (i.e. pitch). However, such inclinations are not actually the two inclinations described above. The inclinations should undergo some calculation, specifically matrix calculation, thereby complicating the algorithm for the antenna stabilization.

According to this invention, the two-axis inclination detecting means is used to detect the inclination around the elevation axis and the inclination around the hypothetical axis in the plane perpendicular to the elevation axis, thereby assuring stabilization of antenna without complicated arithmetic operations.

DETAILED DESCRIPTION

Preferred embodiments of this invention will now be described with reference to the accompanying drawings.

Figure 1:
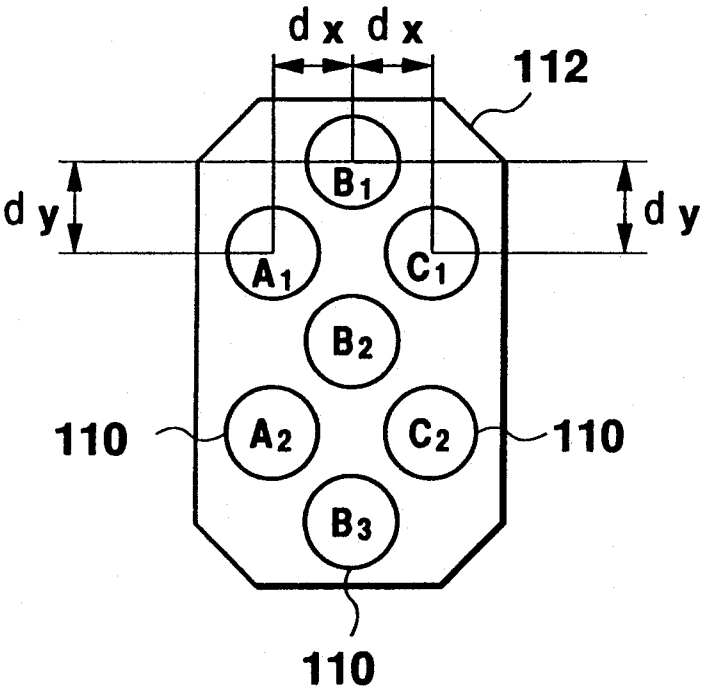
FIG. 1 shows the arrangement of antenna elements of an antenna for a stabilized antenna system according to one embodiment of this invention.

FIG. 1 shows the (2, 3, 2) arrangement of antenna elements of an array antenna.

As shown in FIG. 1, two or three antenna elements 110 in each column are arranged in a staggered manner. A total of seven antenna elements are arranged on a base plate 112 in the staggered manner. When a horizontal distance and a vertical distance between two adjacent antenna elements are expressed by dx, dy, respectively, the horizontal distance is within a range of $dx<0.6\lambda$.

The horizontal distance should be preferably kept in this range to suppress the sidelobes. Generally, the slantwise distance $d=((dx)^2+(dy)^2)^{1/2}$ between slantingly adjacent two antenna elements is generally larger than $\lambda/2$.

Since the antenna elements can be arranged as described above, an array antenna having preferable sidelobe characteristics can be realized. For instance, if there should be a distance d of 0.13 (m) or more between two adjacent antenna elements to reduce mutual interferences of the elements, both dx and dy should be 0.13 (m) or more in the conventional lattice arrangement shown in FIG. 18. However, with this invention, dx can be made much smaller. For instance, when $dx=0.09$ (m), $dy=0.09$ (m), d can be approximately 0.13 (m). Therefore, it is possible that dx can be reduced to realize the array antenna with low sidelobe level although the distance d between the adjacent antenna elements can be maintained.

The horizontal distance dx is set to $0.6\lambda$ or less to suppress the sidelobe suitably.

Figure 2:
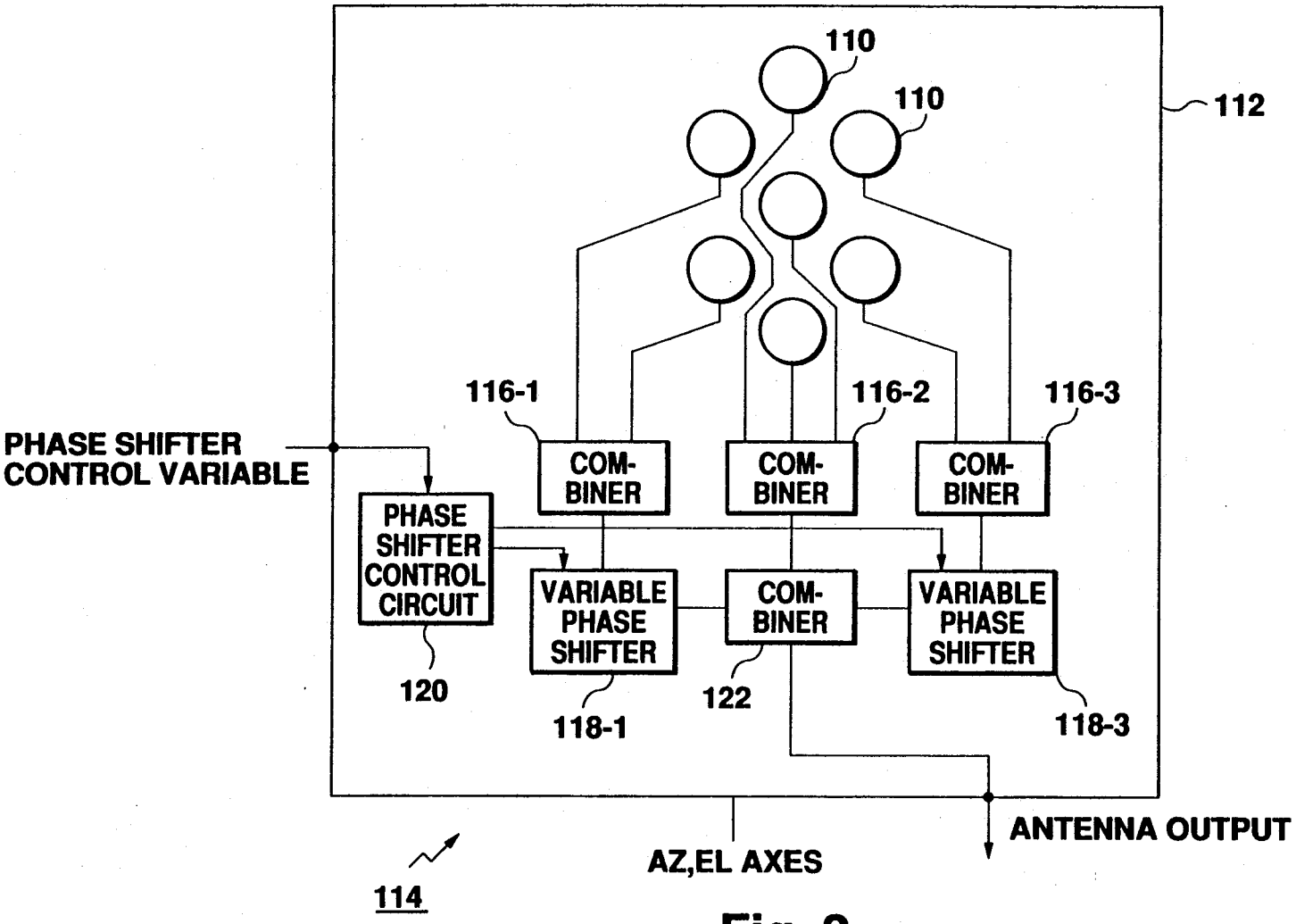
FIG. 2 shows the circuit configuration of the antenna of the first embodiment.

FIG. 2 shows the circuit configuration of the antenna 114 in which the XEL axis is electronically steered.

The array antenna 114 includes a base plate 112 on which antenna elements 110 are arranged in (2, 3, 2) pattern. The following description is also applicable to an array antenna whose element arrangement pattern is (2, 2, 2). The antenna elements 110 are attached as electrodes on the base plate 112 of the array antenna 112. The base plate 112 is superimposed on a feeder plate via insulating material. Circuits related to the antenna elements 110 are mounted on the feeder plate. Since the structure and configuration of the antenna elements 112 are not an essential feature of this invention, the antenna elements 112 may be made and arranged to meet the object of this invention.

The antenna elements 110 in each column are connected to combiners 116-1, 116-2, 116-3 associated with the respective columns. Specifically, the combiners 116 combine signals outputted by the antenna elements 110 in the associated columns. The combiners 116-1 and 116-3 associated with the peripheral columns of the antenna elements 110 are connected to variable phase shifters 118-1, 118-3, respectively. The variable phase shifters 118-1, 118-3 phase-shift the signals from the combiners 116-1 or 116-3 based on signals supplied by a phase shifter control circuit 120. Outputs from the variable phase shifter 118-1, combiner 116-2 and phase shifter 118-3 are supplied to the combiner 122. The combiner 122 combines these outputs, supplying them to an antenna output processing unit to be described later.

The phase shifter control circuit 120 controls the variable phase shifters 118-1, 118-3 according to control variables of the phase shifters. The phase shifter control variables have values corresponding to beam directivity to be realized by the array antenna 114.

Figure 3:
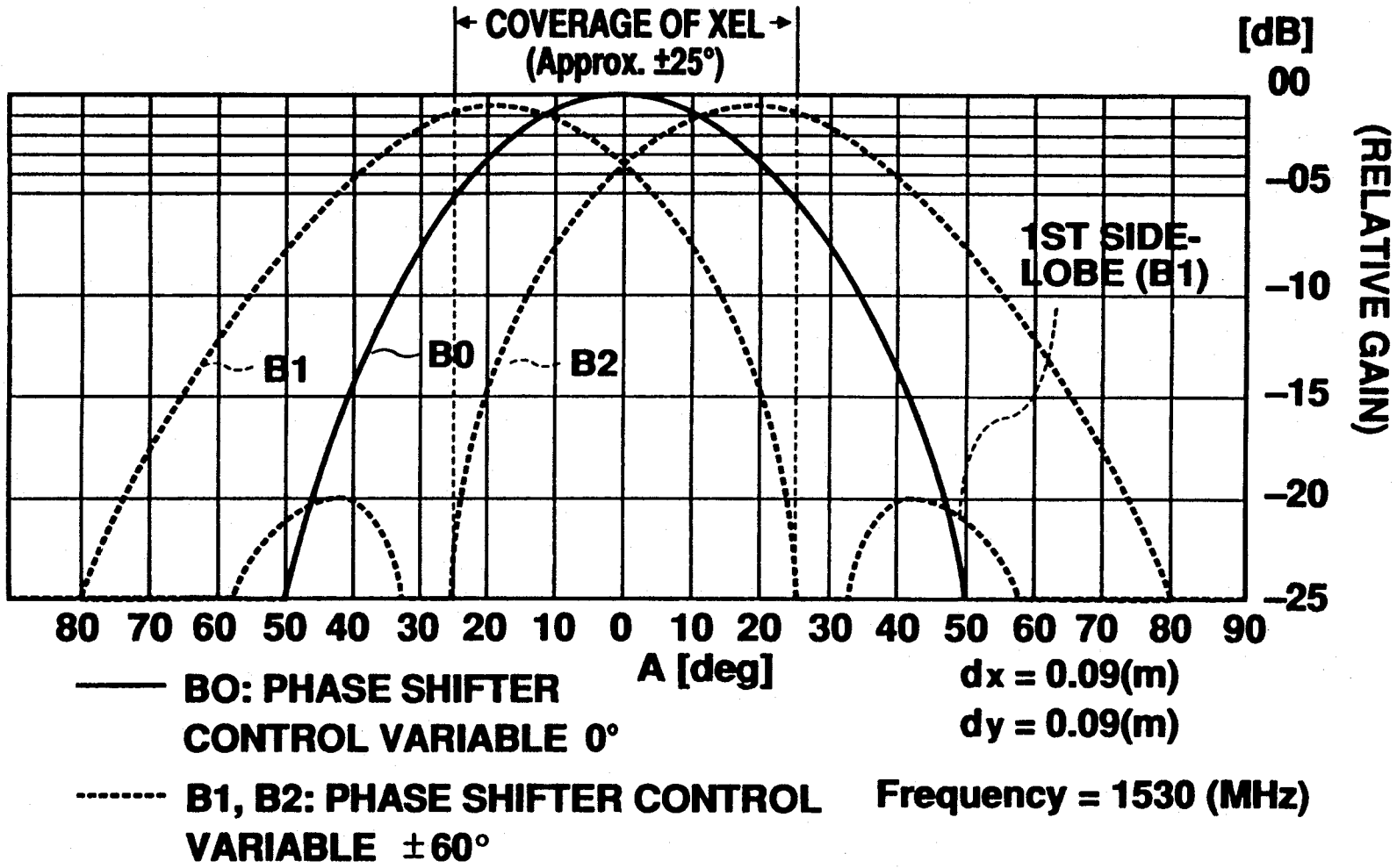
FIG. 3 shows antenna patterns of the antenna of the first embodiment.

FIG. 3 shows antenna patterns as one example of beam control by the array antenna 114 in this embodiment.

To obtain the antenna patterns as shown in FIG. 3, the variable phase shifters 118-1, 118-3 are used as 2-bit variable phase shifters. Specifically, these phase shifters 118-1, 118-3 control the amount of phase shift according to values of 2-bit digital signals from the phase shifter control circuit 120.

The digital signals, i.e. the value of the signals from the phase shifter control circuit 120 to the variable phase shifters 118-1, 118-2 correspond to a beam number on one to one basis.

The beam number is assigned to each beam of the array antenna 114. For instance, beam B0 has a maximum gain at 0°. Beam B1 has a maximum gain at about −17°. To obtain the beam B0, digital signals representing 0° are sent to the variable phase shifters 118-1, 118-3, respectively. To obtain the beam B1, a digital signal for +60° and a digital signal for −60° are respectively sent to the variable phase shifters 118-1, 118-3.

Inclination of the beams thus obtained varies around the hypothetical axis (XEL axis) which is parallel to columns and is perpendicular to EL axis. In other words, since the outputs of the antenna elements in each column are individually combined, and since phase shift is applied to the peripheral columns, directivity of the beams varies around the XEL axis as shown in FIG. 3. This hypothetical XEL axis is parallel to columns, so that the XEL axis is steered electronically.

Figure 18:
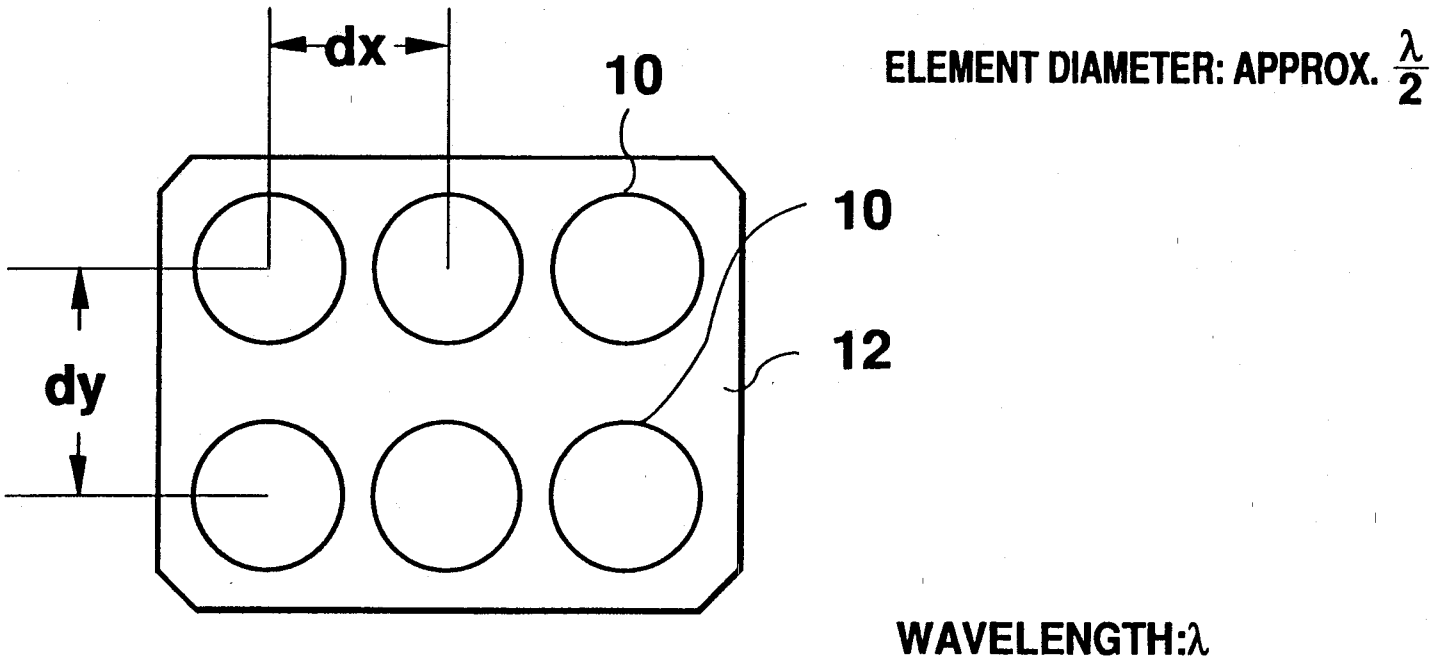
Fig. 18 PRIOR ART
FIG. 18 shows the arrangement of antenna elements in a conventional stabilized antenna system.
Figure 19:
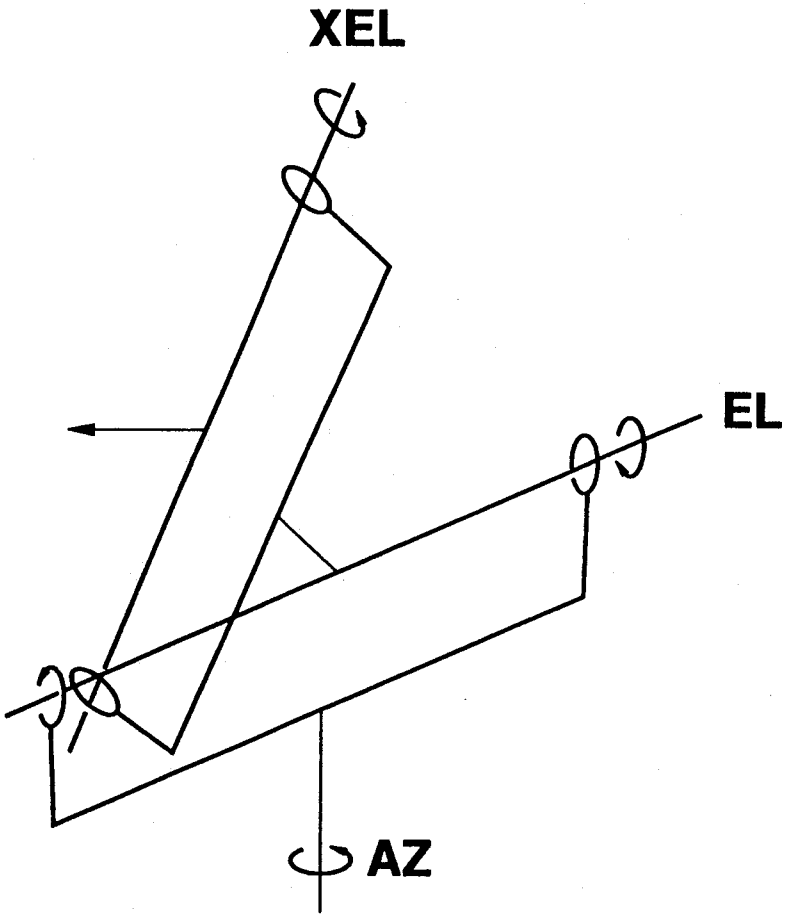
Fig. 19 PRIOR ART
FIG. 19 shows the structure of an AZ-EL-XEL mount.
Figure 20:
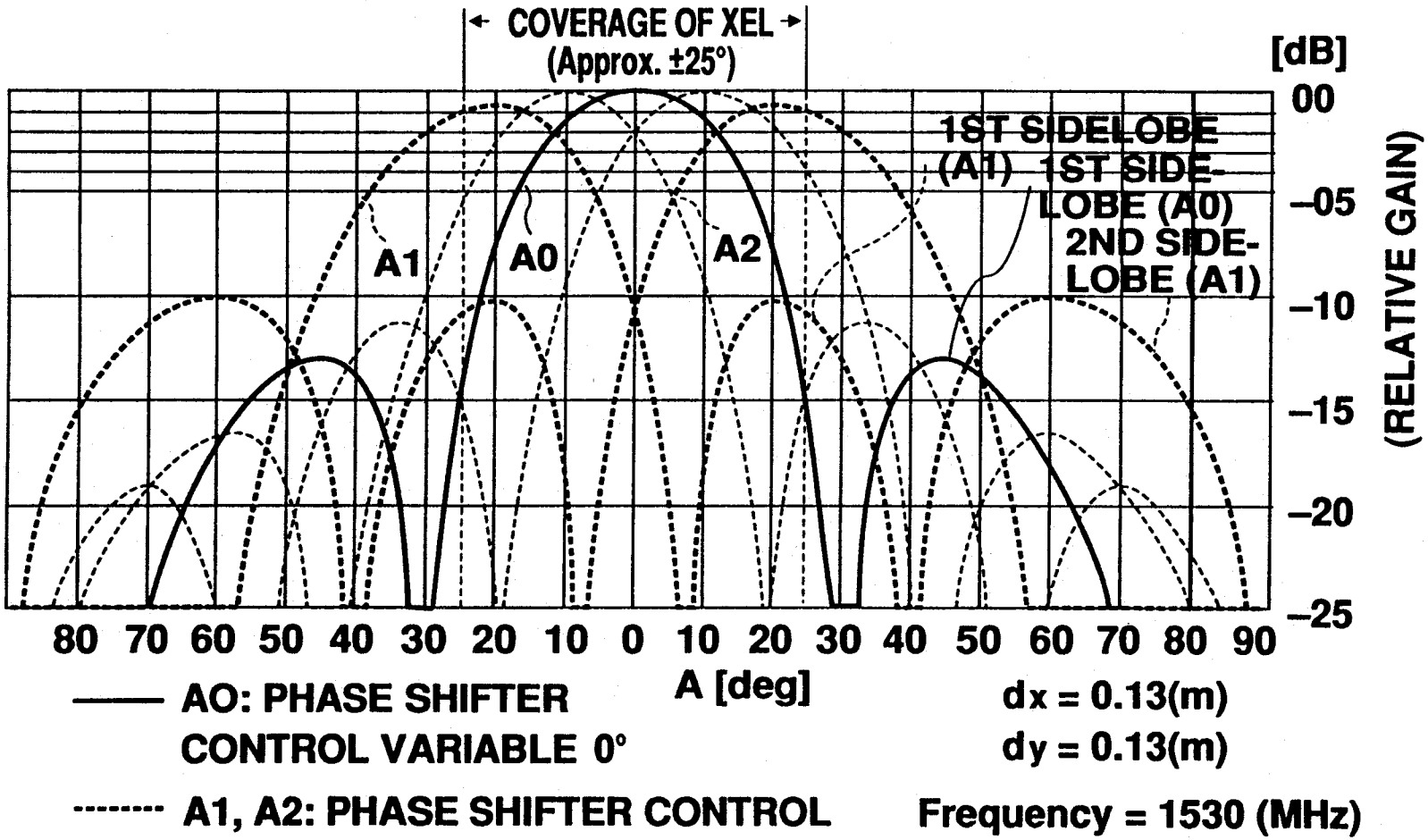
Fig. 20 PRIOR ART
FIG. 20 shows antenna patterns of the conventional lattice arrangement array antenna system.

Further, the antenna patterns with 3 beam positions shown in FIG. 3 are obtained when two control bits are used for the variable phase shifters 118-1, 118-3. In this embodiment, the (2, 3, 2) elements staggered arrangement array antenna (as shown in FIG. 1) with two 2-bits phase shifters (3 beam positions) covers the necessary angular range of plus/minus 25° around XEL axis within 1 dB (or less) gain reduction as shown in FIG. 3. On the other hand, the (2, 2, 2) elements conventional lattice array antenna (as shown in FIG. 18) with two 3-bits phase shifters (5 beams) covers the necessary angular range (±25°) around the XEL axis within 1 dB gain reduction as shown in FIG. 20. In other words, the antenna system of this invention can cover a necessary angular range by using the variable phase shifters 118-1, 118-3 having a small number of bits.

The antenna patterns of FIG. 3 are patterns along the beam steering direction, i.e. around the XEL axis. Further, because the array antenna 114 is longer along the column than the array antennas shown in FIG. 18, the beams become steeper around the elevation axis than the beams shown in FIG. 18. Then, the array antenna 114 suffers less from sea-surface reflection compared with the antenna shown in FIG. 18.

Further, when seven antenna elements 110 are arranged in an array, an antenna gain of about 15 dBi can be obtained.

Figure 4:
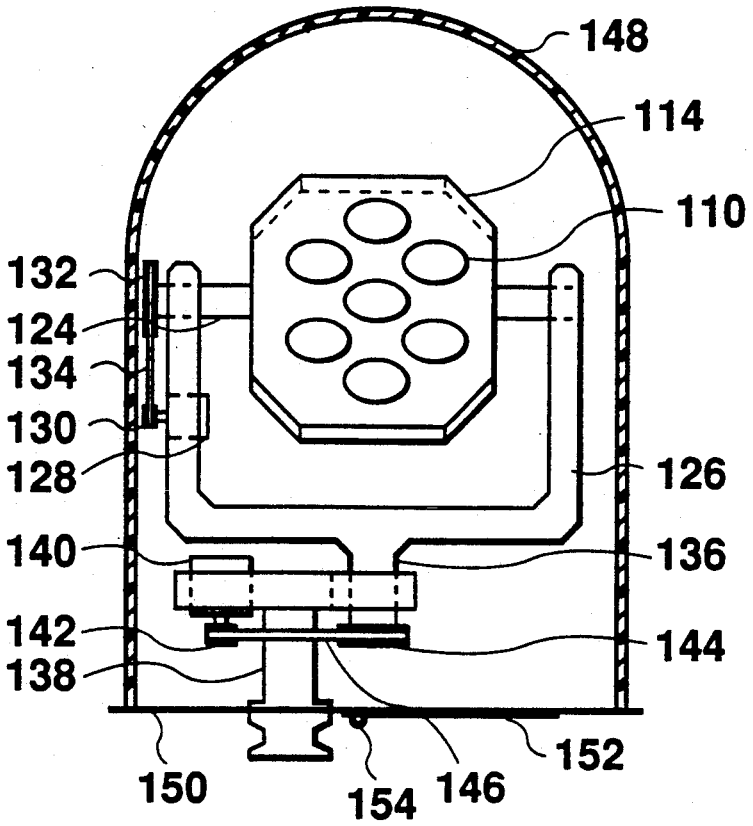
FIG. 4 is a side cross-sectional view of the antenna.

FIG. 4 shows the structure of a stabilized antenna system of the first embodiment of this invention.

The array antenna 114 includes antenna elements 110 which are arranged in (2, 3, 2) pattern. A receiver front end, a variable phase shifter 118 and combiners 116, 122 (which are not shown) are mounted on the rear side of the array antenna 114. The XEL axis is electronically steered by control of the variable phase shifter as described later.

The array antenna 114 is pivotally supported on an azimuth axis frame 126 by an elevation axis 124. The EL axis motor 128 is mounted on the azimuth axis frame 126. The EL axis motor 128 is coupled to one end of the elevation axis 124 via gears 130, 132 and a belt 134. When the EL axis motor 128 is driven for rotation, the array antenna 114 moves pivotally on the elevation axis 124. In other words, the EL axis motor 128 steers the EL axis mechanically.

The azimuth axis frame 126 is integral with an azimuth axis 136. The azimuth axis 136 is located at the lower part of the azimuth axis frame 126, and is rotatably fixed on an eccentric support 138. Specifically, as the azimuth axis 136 rotates, the azimuth axis frame 126 and the array antenna 114 moves, changing the azimuth of the array antenna 114.

An AZ axis motor 140 is mounted on the support 138, and is coupled to the azimuth axis 136 via gears 142, 144 and a belt 146. The AZ motor 140 is driven to move the azimuth axis 136.

In this embodiment, the support 138 is fixedly attached to the bottom of a radome 148. The radome 148 is made of material which can pass the radio waves transmitted and received from and by the array antenna 114. The radome 148 is usually made of FRP.

The support 138 is mounted on a radome base 150 at a position which is eccentric from the center thereof. The support 138 is in the shape of inverted L, supporting the array antenna 112 and associated members on the radome base 150. Therefore, there is a distance at the center of the radome base 150 (right under the array antenna 114). An access hutch 152 is located on this distance.

The access hutch 152 is used for inspection and maintenance work of the array antenna 114, and is open and closed by a hinge 154. As described above, the array antenna is supported on the radome base 150 eccentric. This eccentric supporting results the access hutch 152 with enough area for the work. In this embodiment, the area is consistent with the small radome 148.

As described above, the AZ axis motor 130 and the EL axis motor 128 steer the azimuth axis 136 and the elevation axis 124, respectively. In other words, AZ axis and EL axis are realized by the azimuth axis 136 and the AZ axis motor 130 and by the elevation axis 124 and EL axis motor 128, respectively. Further, the XEL axis is electronically controlled according to the phase shift of the antenna elements of the array antenna 114. The array antenna 114 employs the special AZ-EL mount with the electronic XEL axis. The AZ and EL axes are mechanically controlled, and the XEL axis is electronically controlled.

Figure 5:
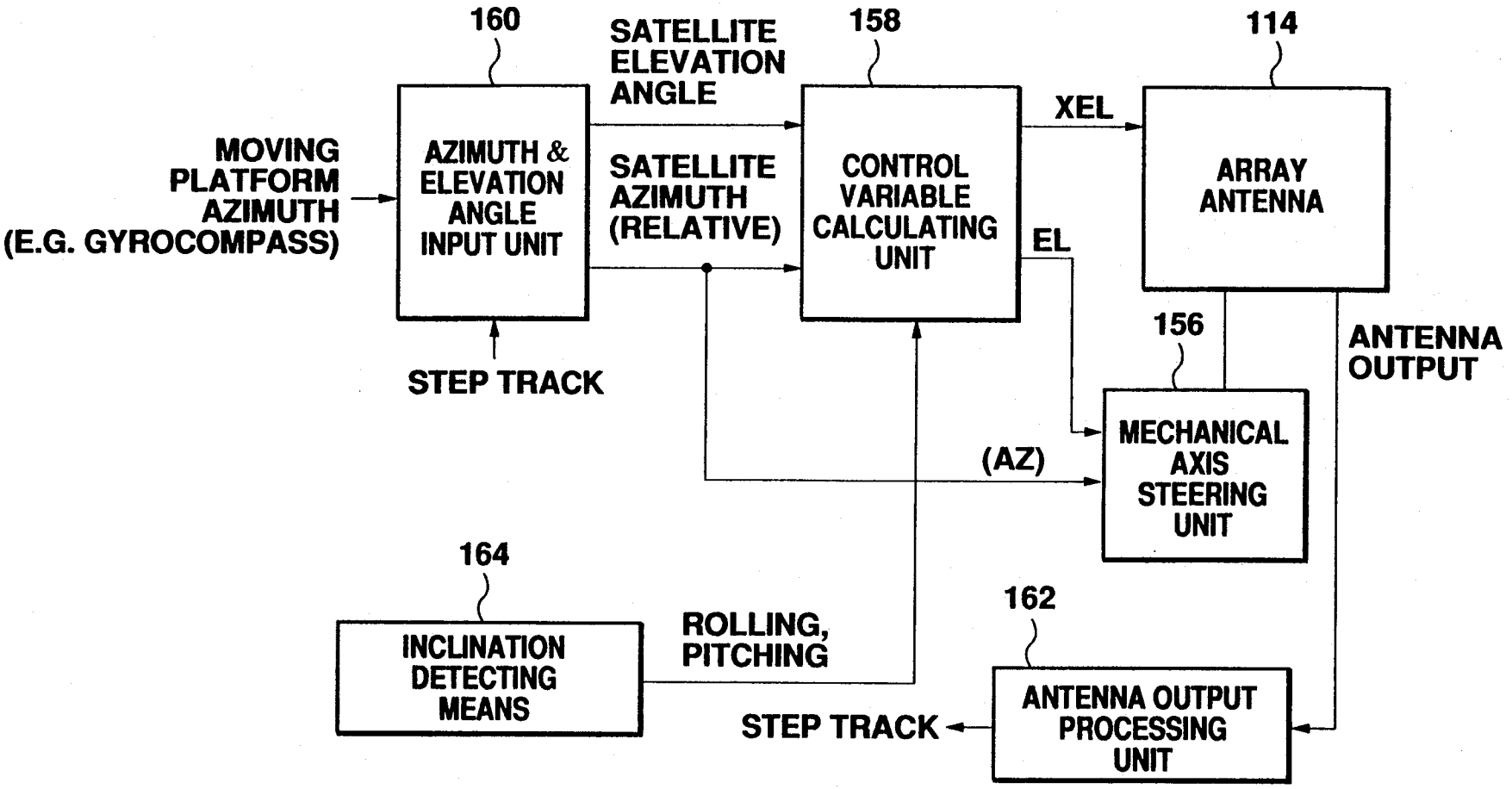
FIG. 5 is a block diagram showing the overall circuit configuration.

The circuit configuration of the antenna system including the array antenna 114 will be now described referring to FIG. 5.

The antenna system comprises the array antenna 114, a mechanical axis driving unit 156 for steering the azimuth axis 136 and the elevation axis 124, a control variable calculating unit 158 for applying a control variable of the EL axis to the mechanical axis driving unit 156 and for calculating a control variable of the variable phase shifter 118 of the array antenna 114, an azimuth & elevation angle input unit 160 for receiving an azimuth of the moving platform from means such as gyrocompass, determining an elevation angle and azimuth of the satellite and supplying data to the control variable calculating unit 158, an antenna output processing unit 162 for receiving outputs from the combiner 122 of the array antenna 114, processing the outputs as predetermined and outputting a step tracking angle, and inclination detecting means 164 for detecting inclination of the moving platform on which the antenna system is installed.

Figure 6:
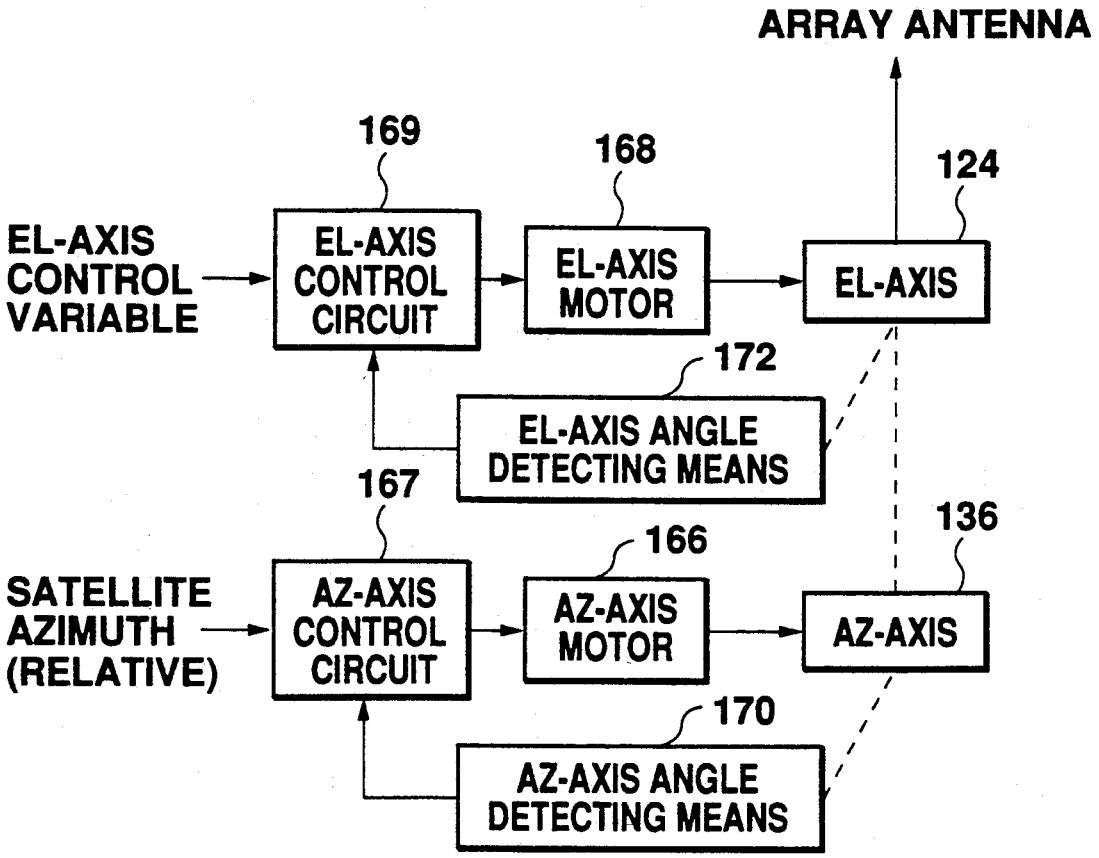
FIG. 6 is a block diagram showing the configuration of a mechanical axis steering unit.

The mechanical axis steering unit 156 has the circuit configuration shown in FIG. 6. The steering unit 156 includes an AZ axis motor 166 for steering the azimuth axis 136 and an EL axis motor 168 for steering the elevation axis 124. Further, the driving unit 156 includes AZ axis angle detecting means 170 for detecting an angle of the azimuth axis 136 and elevation angle detecting means 172 for detecting an angle of the elevation axis 124, both of which are connected to an AZ axis control circuit 167 and an EL axis control circuit 169, respectively.

The AZ axis control circuit 167 and EL axis control circuit 169 drive the AZ axis motor 166 and EL axis motor 168, respectively, and steer the azimuth axis 136 and elevation axis 124, respectively, in response to the AZ and EL control variables supplied from the azimuth & elevation angle input unit 160. The AZ axis control variable is equivalent to a relative azimuth of the satellite (hereinafter called "relative azimuth") for the moving platform. Rotary encoders, for example, are used as the AZ axis angle detecting means 170 and EL axis angle detecting means 172.

According to the AZ axis control variable, the AZ axis control circuit 167 drives the motor 166 to steer the azimuth axis 136. An angular movement of the azimuth axis 136 is detected by the AZ axis angle detecting means 170. The AZ axis control circuit 167 adjusts the angle of the azimuth axis 136 according to the angle detected by the AZ axis angle detecting means 170. Specifically, the AZ axis control circuit 167, motor 166 and AZ axis angle detecting means 170 form a servo control loop for the azimuth axis 136.

Similarly, the EL axis control circuit 169 drives the EL axis motor 168 according to an EL axis control variable supplied from the control variable calculating unit 158. The EL axis angle detecting means 172 detects an angle of the EL axis 124 and informs it to the EL axis control circuit 169.

The mechanical axis steering unit 156 steers the mechanical axes (AZ axis and EL axis) of the array antenna 114.

Figure 7:
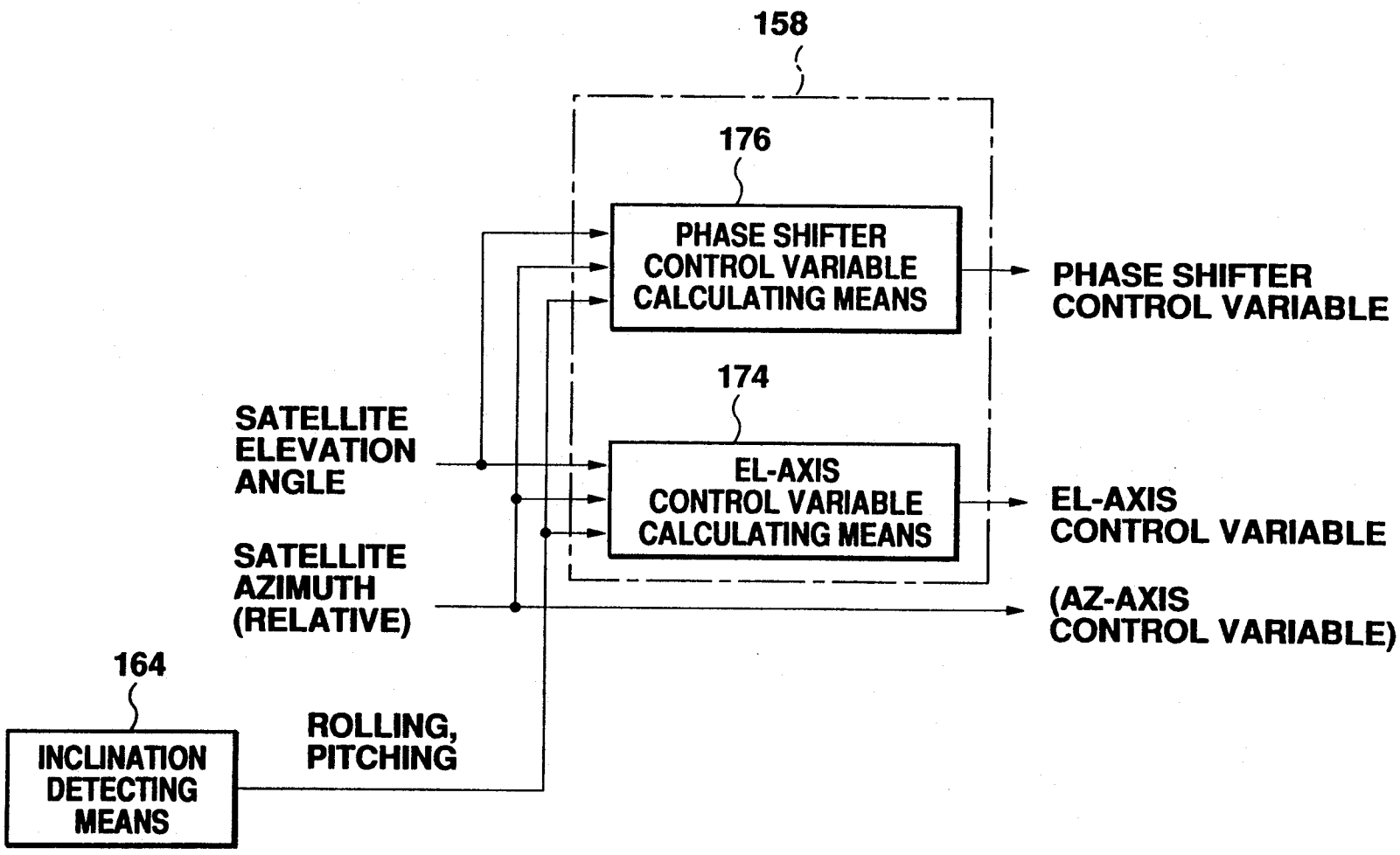
FIG. 7 is a block diagram showing the configuration of a control variable calculating unit.

FIG. 7 shows the configuration of the control variable calculating unit 158. The control variable calculating unit 158 includes EL axis control variable calculating means 174 and phase shifter control variable calculating means 176. The calculating means 174 calculates the control variable for the EL axis, and the calculating means 176 calculates the control variable for the phase shifter.

These control variables are calculated based on the elevation angle and azimuth of the satellite received from the azimuth & elevation angle input unit 160. The elevation angle of the satellite represents an angle which is the angular altitude of the satellite above the moving platform where the antenna system is installed. The azimuth of the satellite represents the horizontal direction, i.e. relative azimuth, of the satellite from the moving platform, and is not an absolute azimuth which is the horizontal direction of the satellite from a reference point like a longitude.

The EL-axis control variable calculating means 174 and phase shifter control variable calculating means 176 receive data concerning rolling and pitching from the inclination detecting means 164. Rolling and pitching are components constituting inclination of the moving platform. The calculating means 174, 176 control the elevation angle of the array antenna 114 according to the rolling and pitching, calculating control variables to steer the beam.

In this embodiment, the control variables are calculated based on the relative azimuth of the satellite tracked by steering the azimuth axis 136, steering the elevation axis 124, and steering the beam so that the inclination of the moving platform will be compensated.

The calculation is performed based on the fundamental arithmetic expression in which change of a polar coordinate fixed on the moving platform to another polar coordinate due to inclination of the moving platform is expressed as Euler's transformation. It should be noted that the relative azimuth of the satellite can be used as the AZ axis control variable without any modification.

The principle of antenna stabiliazation in this embodiment, particularly an algorithm of the control variable calculating unit 158 shown in FIG. 7, will be described here.

Figure 8:
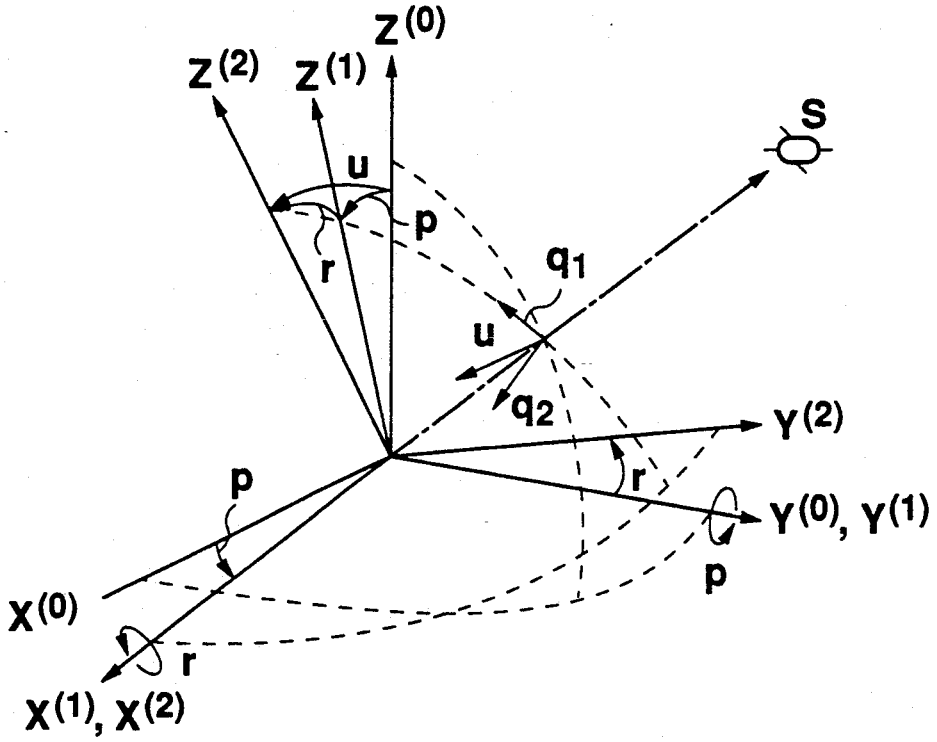
FIG. 8 shows the principle for stabilization.

FIG. 8 shows the relation between the XYZ orthogonal coordinate when the moving platform is not inclined, and the XYZ coordinate under inclination of the moving platform. It is now assumed that the antenna system of this embodiment is installed on a ship and that the X-axis represents the direction of the bow, the Z-axis represents the zenith, and the XY plane is horizontal while the moving platform is not inclined. The X, Y, Z axes are expressed as $X^{(0)}$, $Y^{(0)}$, $Z^{(0)}$, respectively.

The inclination applied to the ship includes pitching and rolling components, both of which can be expressed in terms of angles. Pitching and rolling are equivalent to angularly moving the XYZ orthogonal coordinate. For instance, pitching corresponds to moving the XYZ orthogonal coordinate around the Y-axis by a pitching angle p. Rolling corresponds to moving the XYZ orthogonal coordinate around the X-axis by a rolling angle r.

The above will be described in detail. Inclination expressed by the pitching angle p and the rolling angle r occurs on the $X^{(0)}$ $Y^{(0)}$ $Z^{(0)}$ orthogonal coordinate. Firstly, the orthogonal coordinate is moved around the $Y^{(0)}$ by the pitching angle p. After this, the axes are respectively expressed as $X^{(1)}$, $X^{(1)}$, $Z^{(1)}$. Secondly, the orthogonal coordinate is moved around the $X^{(1)}$ by the rolling angle r. Then, the axes are expressed as $X^{(2)}$, $Y^{(2)}$, $Z^{(2)}$.

After two angular movements of the coordinates, the coordinate $X^{(0)}$ $Y^{(0)}$ $Z^{(0)}$ is switched to the orthogonal coordinate $X^{(2)}$ $Y^{(2)}$ $Z^{(2)}$.

In this embodiment, stabilization is performed by controlling the EL and XEL axes, and the AZ axis is controlled to perform tracking related to the relative azimuth. Therefore, it is necessary to resolve the inclination $u\phi$ in view of the vector into a component $q_1$ around the EL axis and a component $q_2$ around the XEL axis.

Firstly, the orthogonal coordinates $X^{(0)}$ $Y^{(0)}$ $Z^{(0)}$ are moved by the pitching angle p. Then the angularly moved coordinate is moved by the rolling angle r. Then the two components $q_1$ and $q_2$ are calculated by the algorithm which is obtained from the following fundamental equation.

$$\begin{pmatrix} 0 \\ 0 \\ 1 \end{pmatrix} = (\xi)_X(\eta)_Y(\phi)_Z(R)_X(P)_Y \begin{pmatrix} x \\ y \\ z \end{pmatrix}$$

where $(x, y, z)^T$ is position vector in the XYZ coordinate system; $(P)_Y$: a matrix for moving the orthogonal coordinate $X^{(0)}$ $Y^{(0)}$ $Z^{(0)}$ around the $Y^{(0)}$ by the pitching angle p; $(R)_X$: a matrix for moving the orthogonal coordinate $X^{(1)}$ $Y^{(1)}$ $Z^{(1)}$ around the $X^{(1)}$ axis by the rolling angle r; $(\phi)_Z$: matrix for moving the orthogonal coordinate $X^{(2)}$ $Y^{(2)}$ $Z^{(2)}$ around the $Z^{(2)}$ axis according to a variation $\phi$ of the relative azimuth of the satellite to change this orthogonal coordinate to an orthogonal coordinate $X^{(3)}$ $Y^{(3)}$ $Z^{(3)}$; $(\eta)_Y$ and $(\xi)_X$: matrices representing a control variable around the $Y^{(3)}$ axis and a control variable around the $X^{(3)}$, respectively, and are used to compensate for the inclination expressed by $(P)_Y$ and $(R)_X$ and variation $\phi$ of the relative azimuth of the satellite to track the satellite efficiently. All of these matrices are $3\times3$ matrices. It is now assumed:

$$(R)_X = \begin{pmatrix} 1 & 0 & 0 \\ 0 & \cos r & \sin r \\ 0 & -\sin r & \cos r \end{pmatrix}$$

$$(P)_Y = \begin{pmatrix} \cos p & 0 & -\sin p \\ 0 & 1 & 0 \\ \sin p & 0 & \cos p \end{pmatrix}$$

Modifying the formula assuming that $(\ )^{-1}$ represents a inverse matrix, the following is obtained:

$$(\eta)_Y^{-1}(\xi)_X^{-1} \begin{pmatrix} 0 \\ 0 \\ 1 \end{pmatrix} = (\phi)_Z(R)_X(P)_Y \begin{pmatrix} x \\ y \\ z \end{pmatrix} \tag{1}$$

Modifying the left side of the formula, the following is obtained:

$$\begin{pmatrix} \cos\eta & 0 & \sin\eta \\ 0 & 1 & 0 \\ -\sin\eta & 0 & \cos\eta \end{pmatrix} \begin{pmatrix} 1 & 0 & 0 \\ 0 & \cos\xi & -\sin\xi \\ 0 & \sin\xi & \cos\xi \end{pmatrix} \begin{pmatrix} 0 \\ 0 \\ 1 \end{pmatrix} = \begin{pmatrix} \sin\eta & \cos\xi \\ & -\sin\xi \\ \cos\eta & \cos\xi \end{pmatrix} \tag{2}$$

On the other hand, we can say the following relations are existing;

$X = \sin\theta \cos\phi$ $Y = \sin\theta \sin\phi$ $Z = \cos\theta$

These equations are the formula for transformation from orthogonal coordinate to polar coordinate when R(radius) = 1. Modifying the right side of the fundamental equation, $$\begin{pmatrix} \cos\phi\cos p + \sin\phi\sin r\sin p & \sin\phi\cos r \\ -\sin\phi\cos p + \cos\phi\sin r\sin p & \cos\phi\cos r \\ \cos r\sin p & -\sin r \\ -\cos\phi\sin p + \sin\phi\sin r\cos p & \\ \sin\phi\sin p + \cos\phi\sin r\cos p & \\ \cos r\cos p & \end{pmatrix} * \begin{pmatrix} \sin\Theta\cos\phi \\ \sin\Theta\sin\phi \\ \cos\Theta \end{pmatrix} \tag{3}$$

-continued $$= \begin{pmatrix} \cos^2\phi\sin\Theta\cos p + \sin\phi\cos\phi\sin\Theta\sin r\sin p + \\ \sin^2\phi\sin\Theta\cos r - \cos\phi\cos\Theta\sin p + \\ \sin\phi\cos\Theta\sin r\cos p \\ -\sin\phi\cos\phi\sin\Theta\cos p + \cos^2\phi\sin\Theta\sin r\sin p + \\ \sin\phi\cos\phi\sin\Theta\sin r + \sin\phi\cos\Theta\sin p + \\ \cos\phi\cos\Theta\sin r\cos p \\ \cos\phi\sin\Theta\cos r\sin p - \sin\phi\sin\Theta\sin r + \\ \cos\Theta\cos r\cos p \end{pmatrix}$$

$$= \begin{pmatrix} X^{(3)} \\ y^{(3)} \\ Z^{(3)} \end{pmatrix}$$

where $\eta$: a control variable for the EL axis; $\xi$: a control variable for the XEL axis (beam obtained by phase-shift control); $\phi$: a control variable for the AZ axis, $\Theta$ and $\phi$: coordinate value to express $(x, y, z)^T$ by a unit polar coordinate; and $x^{(3)}$, $y^{(3)}$, $z^{(3)}$ are coordinate values in the orthogonal coordinate of $X^{(3)}$ $Y^{(3)}$ $Z^{(3)}$.

Modifying the formulas (2) and (3), $$\xi = -\sin^{-1} y^{(3)}$$

$$\eta = \tan^{-1} (x^{(3)}/z^{(3)})$$

is obtained.

According to this embodiment, satellite tracking and antenna stabilization are performed based on $\xi$ and $\eta$ which are determined by the matrix calculation. Therefore, the control variable calculating unit 158 might be a micro-processor capable of high speed calculation.

Figure 9:
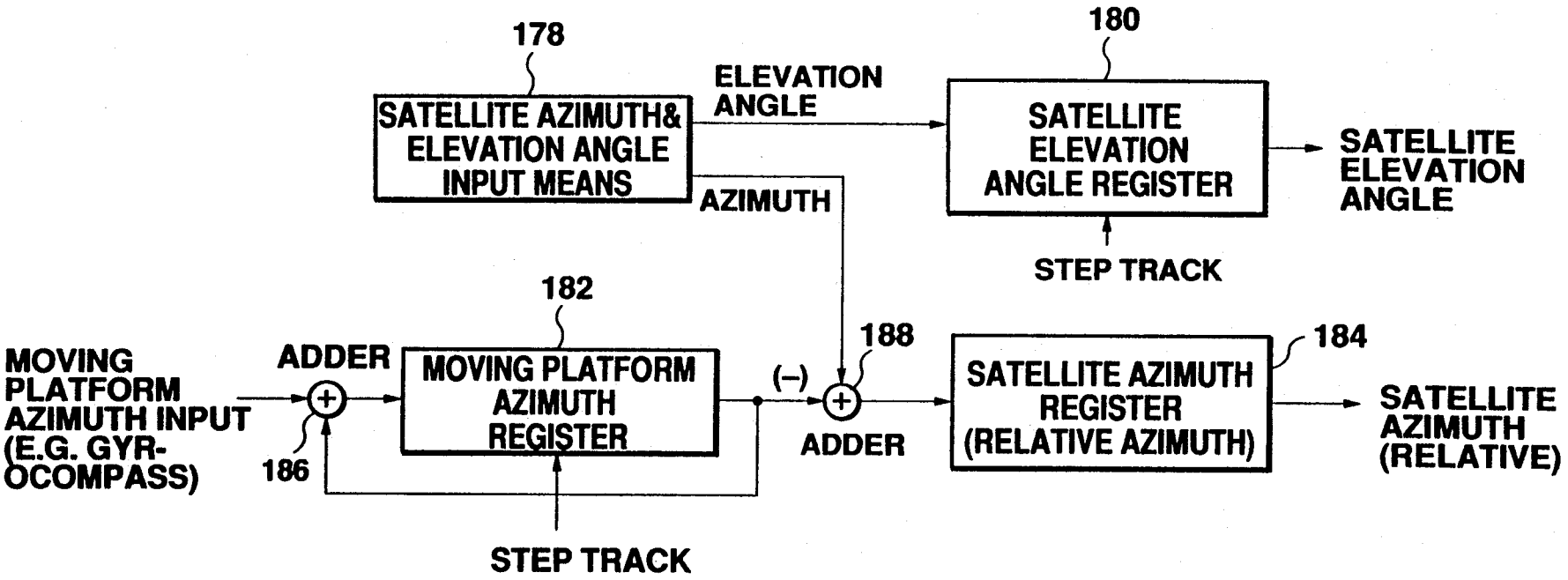
FIG. 9 is a block diagram showing the configuration of an azimuth & elevation angle input unit.

FIG. 9 shows the configuration of azimuth & elevation input unit 160 for supplying data concerning the azimuth and elevation angle of the satellite to the control variable calculating unit 158.

The azimuth & elevation input unit 160 includes means for receiving and storing a position of the moving object from a navigation system like GPS, for example. Specifically, the azimuth & elevation input unit 160 includes satellite azimuth & elevation angle input means 178 for receiving a latitude and a longitude of the moving platform and a position of the satellite to calculate the elevation angle and absolute azimuth of the satellite. Specifically, so along as a position of the satellite is known, the elevation angle and absolute azimuth of the satellite can be determined. The absolute azimuth means a horizontal position of the satellite from the latitude as a reference direction.

The elevation angle of the satellite thus obtained is sent to a satellite elevation angle register 180. The register 180 temporarily stores the satellite elevation angle obtained from the azimuth & elevation angle input means 178, supplying the elevation angle to the control variable calculating unit 158. A step tracking circuit, to be described later, performs step tracking for the satellite elevation angle register 180. Step tracking switches the azimuth and elevation angle of the array antenna 114, so that the antenna points to the satellite accurately.

Further, the azimuth & elevation angle input unit 178 includes a moving platform azimuth register 182 and satellite azimuth register 184. The register 182 stores the azimuth of the moving platform where the antenna system is installed. Specifically, outputs from the gyrocompass represent variations of the azimuth of the moving platform. These variations are sequentially added to determine the azimuth of the moving platform. For this calculation, inputs from the gyrocompass are inputted in an adder 186 disposed upstream of the moving platform azimuth register 182. The adder 186 adds the moving platform azimuth stored in the moving platform azimuth register 182 and the input from the gyrocompass, updating the contents of the moving platform azimuth register 182 based on the added results.

An adder 188 is located downstream of the moving platform azimuth register 182. The adder 188 receives not only the contents of the moving platform azimuth register 182 but also the satellite absolute azimuth determined by the satellite azimuth & elevation angle input means 178. The adder 188 deducts the contents of the moving platform azimuth register 182, i.e. the moving platform azimuth, from the satellite absolute azimuth inputted from the satellite azimuth & elevation angle input means 178, thereby determining a relative azimuth of the satellite. The relative azimuth of the satellite thus determined is temporarily stored in a satellite azimuth register 184, then being supplied to the control variable calculating unit 158 and mechanical axis steering unit 156. According to this embodiment, the azimuth & elevation angle input means 160 determines the elevation angle and relative azimuth of the satellite based on the latitude and longitude obtained by GPS. The azimuth of the moving platform is corrected, thereby correcting the relative azimuth of the satellite based on the gyrocompass input.

Step tracking is performed for the moving platform azimuth register 182 similarly to the satellite elevation angle register 180.

Figure 10:
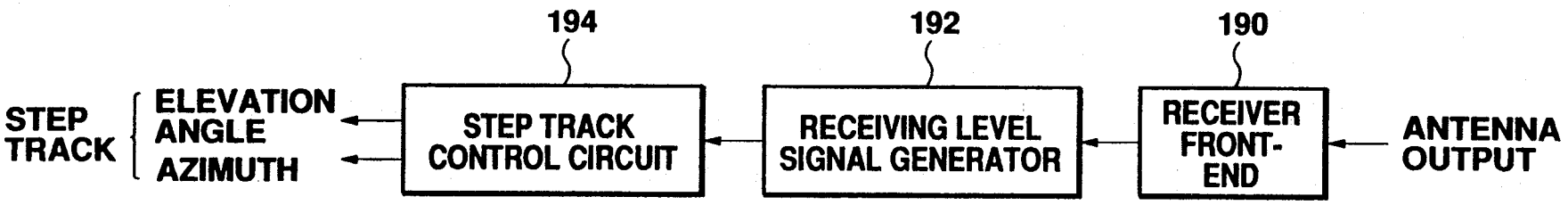
FIG. 10 is a block diagram showing the configuration of an antenna output processing unit.

FIG. 10 shows the configuration of the antenna output processing unit 162 employed in this embodiment.

The antenna output processing unit 162 is a circuit serving as part of a radio equipment related to the array antenna 114. Specifically, when installed on the moving platform such as ship, the stabilization antenna system of this embodiment transmits and receives radio waves to and from the satellite communication system or satellite broadcasting system. Therefore, the antenna system is connected to or made integral with circuits for transmitting and receiving the radio waves. FIG. 10 shows part of the circuit related to the transmitting and receiving unit for the satellite communications or broadcasting system, particularly the circuit for detection of azimuth errors.

The antenna output processing unit 162 shown in FIG. 10 includes a receiver front-end 190, receiving level signal generator 192 and a step track control circuit 194.

The receiver front-end 190 receives outputs from the array antenna 114, having such component as LNA, and is mounted on the rear side of the base plate of the array antenna 114. Usually the level of the antenna output is very low level. Therefore, it is necessary to amplify the antenna output to a predetermined level, so that the receiver front-end 190 including LNA is disposed in the vicinity of the array antenna 114.

When signal transmission is performed by the antenna system in which only the receiver front-end 190 is mounted on the rear of the array antenna 114 and the other parts of the receiver are mounted at the bottom of the radome 148, for example, such signal transmission is usually called "RF" transmission. On the other hand, when the entire receiver is disposed on the rear side of the array antenna 114, signal transmission is called "IF" transmission. This invention is applicable to both RF and IF transmissions. Therefore, distinction of RF and IF transmission is not shown in FIG. 10.

The receiving level signal generator 192 located behind the receiver 190 generates receiving level signals based on the outputs from the receiver front-end 190. The receiver front-end 190 converts the frequency of the antenna output into a signal having a lower frequency, outputting the signal as a so-called IF signal. The receiving level signal generator 192 picks up the IF signal, estimates C/No based on a level of a carrier contained in the IF signal, and generates a receiving level signal which is monotonously increased for C/No. Here, C stands for a carrier power, and No stands for noise power per Hz. Therefore, C/No is called "carrier to noise power ratio".

The receiving level signal generated by the signal generator 192 is inputted to the step track control circuit 194 in the succeeding stage. The step track control circuit 194 outputs two kinds of step track angles respectively related to the elevation angle and azimuth based on a value of the receiving level signal. The step track angles outputted by the step track control circuit 194 is supplied to the satellite elevation angle register 180 and the moving platform azimuth register 182, performing fine adjustment of the contents of the registers 180, 182. The step track angles are concerned with this fine adjustment. Either a positive or negative sign is attached to each of the step track angle. The positive or negative sign is selected to increase the value of the receiving level signal according to the receiving level signal obtained from the receiving level signal generating means 192. The configuration of the step track control circuit is disclosed co-pending Japanese Patent Applications Nos. HEI 2-175014 and HEI 2-240413, and will not be described here.

Operation of the antenna system will now be described.

The azimuth & elevation angle input unit 160 receives the azimuth of the moving platform from an apparatus such as gyrocompass. The azimuth of the moving platform is stored in the moving platform azimuth register 182. Step tracking is performed for the moving platform azimuth register 182. The azimuth & elevation angle input unit 160 receives the elevation angle and absolute azimuth of the satellite from the satellite elevation angle and azimuth input means 178. The elevation angle of the satellite is supplied to the satellite elevation angle register 180, being corrected by the step track angle if necessary, and being outputted to the control variable calculation unit 158. On the other hand, the absolute azimuth of the satellite is sent to the adder 188, which deducts the moving platform azimuth from the absolute azimuth of the satellite, supplying a relative azimuth to the satellite azimuth register 184.

The elevation angle and absolute azimuth of the satellite stored in the registers 180, 184 are supplied to the control variable calculation unit 158 and the mechanical axis steering unit 156, respectively. In this case, the EL axis control variable calculating means 174 and phase shifter control variable calculating means 176 effect, based on the elevation angle and relative azimuth of the satellite, arithmetic operations for satellite tracking. The control variable calculating means 174, 176 receive outputs from the inclination detecting means 164. Control variables for antenna stabilization are calculated based on these outputs.

The control variables are calculated to compensate for variations of the satellite azimuth by steering the azimuth axis 136, and to compensate for the elevation angle and inclination by steering the elevation axis 124 and beams. The relative azimuth of the satellite, which is included in the data from the azimuth & elevation angle input unit 160, is inputted as the AZ axis control variable without any modification to the AZ axis control circuit 167 in the mechanical axis control unit 156. The elevation angle of the satellite as well as the relative azimuth is inputted to the control variable calculating unit 158 to determine the control variables for the EL axis and the phase shifters. The control variable for the EL axis is inputted to the EL axis control circuit 169 of the mechanical axis steering unit 156, and the control variable for the phase shifters is inputted to the phase shifter control circuit 120 of the array antenna 114.

The AZ and EL axis control circuits 167, 169 control the AZ and EL axis motors 166, 168, respectively, according to the relative azimuth of the satellite and the EL axis control variable. The phase shifter control circuit 120 of the array antenna 114 controls the amount of phase shift of the phase shifters 118-1, 118-3 by using digital signals according to the control variable for the phase shifters, thereby performing tracking of the satellite and stabilization for inclination of the moving platform.

According to this embodiment, control related to the XEL axis, i.e. control of the phase shift of the variable phase shifters 118-1, 118-3, is simplified. This is because since the array antenna 114 of this invention has very broad beams, 2 or 3 bits of the digital signal outputted from the phase shifter calculating circuit 120 are sufficient.

Further, the array antenna 114 is compact, simple and inexpensive. Specifically, the variable phase shifters 118 are not provided for every antenna element. Therefore, arrangement of the phase shifters 118 and their related circuits are simplified to be less expensive. Further, since the array antenna 114 is supported on the bottom of the radome 148 at a position eccentric from the center of the radome base 150, there is a sufficient distance for the access hutch 152 on the radome base 150. Even when it is small, the array antenna 114 can be maintained easily. This advantage is also obtained when the elevation axis 124 is directly mounted on the radome 148, thereby further reducing the size of the radome 148 since a frame for the elevation axis is not necessary.

Figure 11:
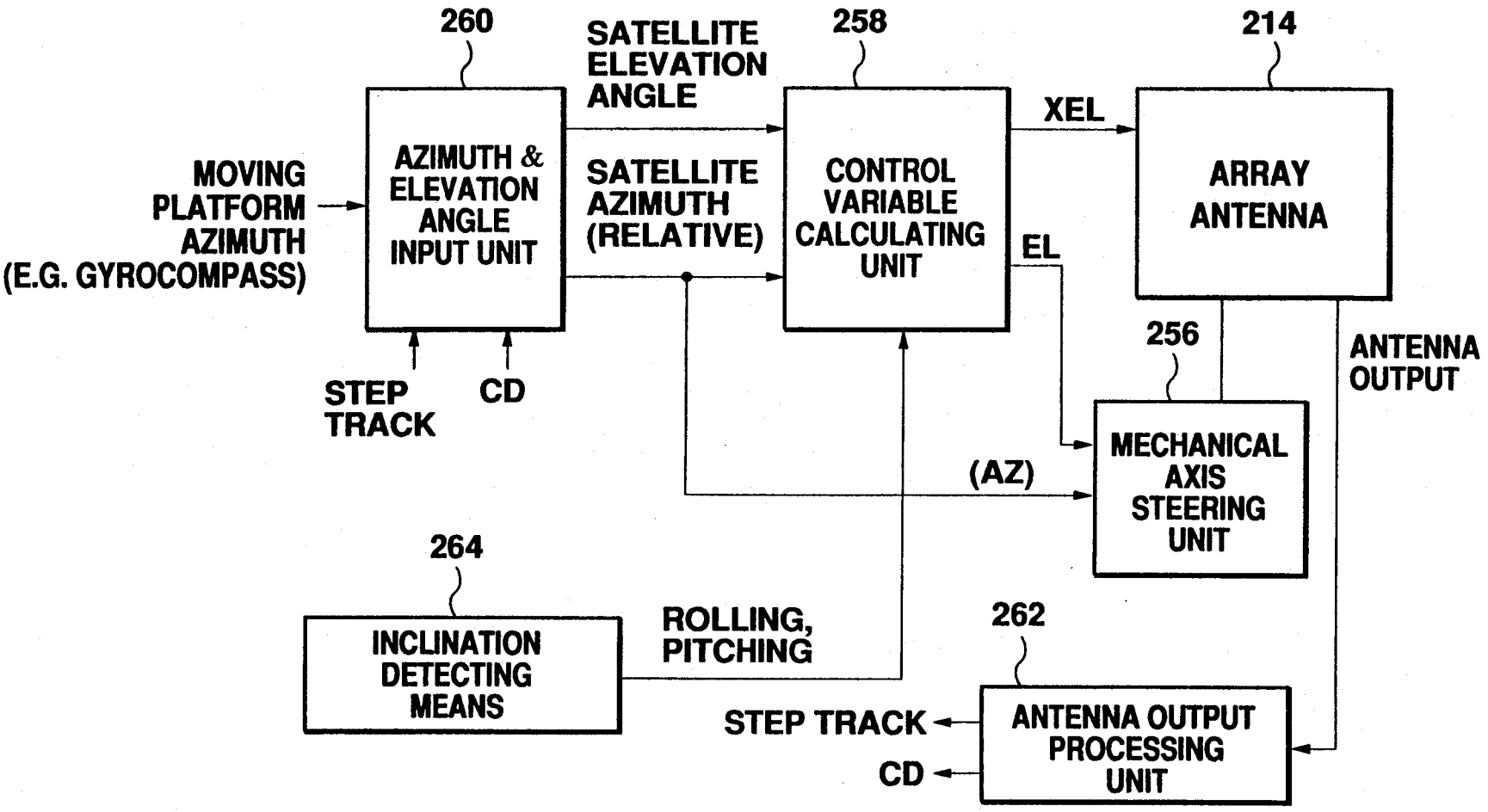
FIG. 11 is a block diagram showing the overall circuit configuration of a stabilized antenna system of a second embodiment.

FIG. 11 shows the circuit configuration of an stabilized antenna system according to a second embodiment of this invention.

This embodiment differs from the first embodiment in that an azimuth & elevation angle input unit 260 determines the relative azimuth of the satellite by search control. In the second embodiment, an array antenna 214, a mechanical axis steering unit 256, a control variable calculating unit 258 and inclination detecting means 264 are identical to those of the first embodiment, and their description will not be made here.

Figure 12:
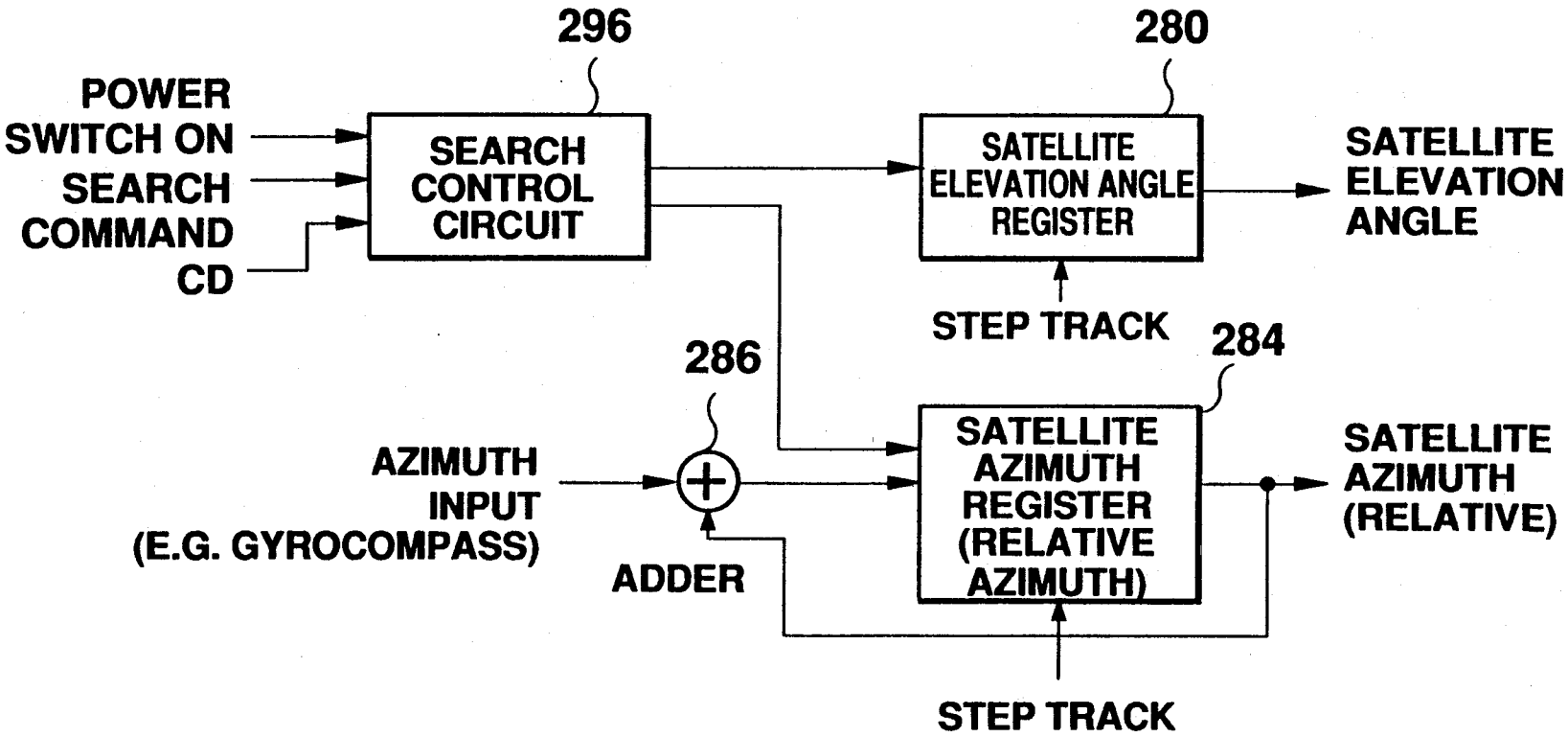
FIG. 12 is a block diagram showing the configuration of an azimuth & elevation angle input unit in the second embodiment.

The azimuth & elevation angle input unit 260 has the circuit configuration as shown in FIG. 12, including a satellite elevation angle register 280, a satellite azimuth register 284 and an adder 286 similarly to the azimuth & elevation angle input unit 160 of the first embodiment. In this embodiment, the satellite azimuth register 284 undergoes step track control if necessary. This is because the relative azimuth of the satellite is directly updated without updating the azimuth of the moving platform. In other words, the azimuth & elevation angle input unit 260 neither includes an apparatus corresponding to the moving platform azimuth register 182 nor receives data concerning the absolute azimuth of the satellite.

In this embodiment, the contents of the satellite azimuth register 284 are added to inputs from the gyrocompass and are sequentially updated by the adder 286. On the other hand, an elevation angle and a relative azimuth of the satellite obtained by search control are stored in the satellite elevation angle register 280 and the satellite azimuth register 284, respectively. Therefore, a search control circuit 296 is used in this embodiment.

The search control circuit 296 performs search in response to turning on of a power switch, a search command from an external unit, and a carrier detection signal (CD) which is generated by a demodulator (to be described later) of the antenna output processing unit 262. The search control circuit 296 is an application of the azimuth search control circuit disclosed in the copending Japanese Patent Application No. HEI 2-240413. In this embodiment, the search control circuit 296 is required to perform search control for the elevation angle and relative azimuth of the satellite.

According to this embodiment, the relative azimuth of the satellite can be determined without using the latitude and longitude of the moving platform.

Figure 13:
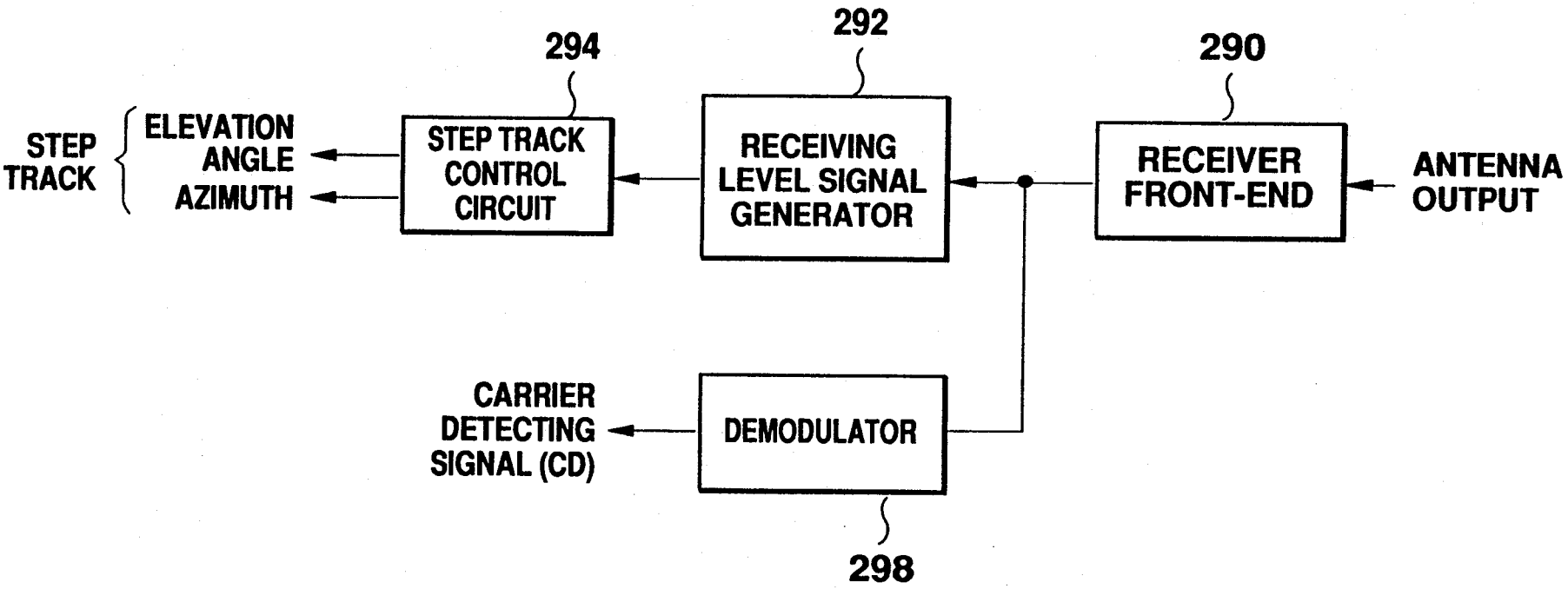
FIG. 13 is a block diagram showing the configuration of an antenna output processing unit in the second embodiment.

FIG. 13 shows the circuit configuration of the antenna output processing unit 262. The antenna output processing unit 262 includes the demodulator 298 besides the components similar to those of the antenna output processing unit of the first embodiment. The demodulator 298 receives an IF signal from a receiver front-end 290 to generate the carrier detection signals (CDs).

The demodulator 298 detects the carrier according to one of fundamental operations of ordinary demodulators, e.g. a PLL method. A number of methods have been developed and practically employed. CD as a result of the carrier detection is a signal indicating whether a desired signal is being received at least at a predetermined level. The demodulator 298 forwards the CD to search control circuit 296 as data as a basis for search control.

Operation of the antenna system of the second embodiment will now be described by noticing the difference from the operation of the antenna system of the foregoing embodiment.

When the power supply is turned on, the search control circuit 296 performs search. Specifically, the search control circuit 296 determines a search control angle, supplying it as the elevation angle and the relative azimuth of the satellite to the satellite elevation angle and azimuth registers 280, 284, respectively. Then, the control variable calculating unit 258 reads the elevation angle and relative azimuth inputted from the elevation angle register 280 and the azimuth register 284, calculating control variables necessary for tracking. Based on the calculated control variables, the mechanical axis steering unit 256 is controlled to move the azimuth axis and elevation axis angularly. Further, a control variable for the phase shifters are determined by the phase shift control variable calculating means, being supplied as a phase shifter control signal to the phase shifter control circuit of the array antenna 214. Then, search related to the XEL axis will be performed. Searching is carried to vary the beam along a spiral starting at the zenith and ending at the horizon.

During search, the output from the array antenna 214 is supplied as CD to the search control circuit 296 via the receiver 290 and demodulator 298. The search control circuit 296 repeats search until a desired CD is obtained. Then, the search control circuit 296 proceeds with its normal operation.

Normally an azimuth detected by the gyrocompass, for example, is inputted to the adder 286. The inputted azimuth is added to the contents of the satellite azimuth register 284 to update the relative azimuth of the satellite. The updated relative azimuth and the elevation angle stored in the satellite elevation angle register 280 are supplied to the control variable calculating unit 258 and the mechanical axis steering unit 256 to calculate the control variable for the satellite tracking. The control variable calculating unit 258 also receives data concerning rolling and pitching of the moving platform from the detecting means 264, calculating control variables for stabilization the based on the predetermined algorithm. Specifically, the control variables related to the EL and XEL axes are calculated.

The control variable for the EL axis is supplied to the mechanical axis steering unit 256, and the control variable for the XEL axis is supplied to the phase shifter control circuit of the array antenna 214.

With the second embodiment of this invention, tracking of the satellite and antenna stabilization can be performed without using position data of the moving platform from the means such as GPS.

Figure 14:
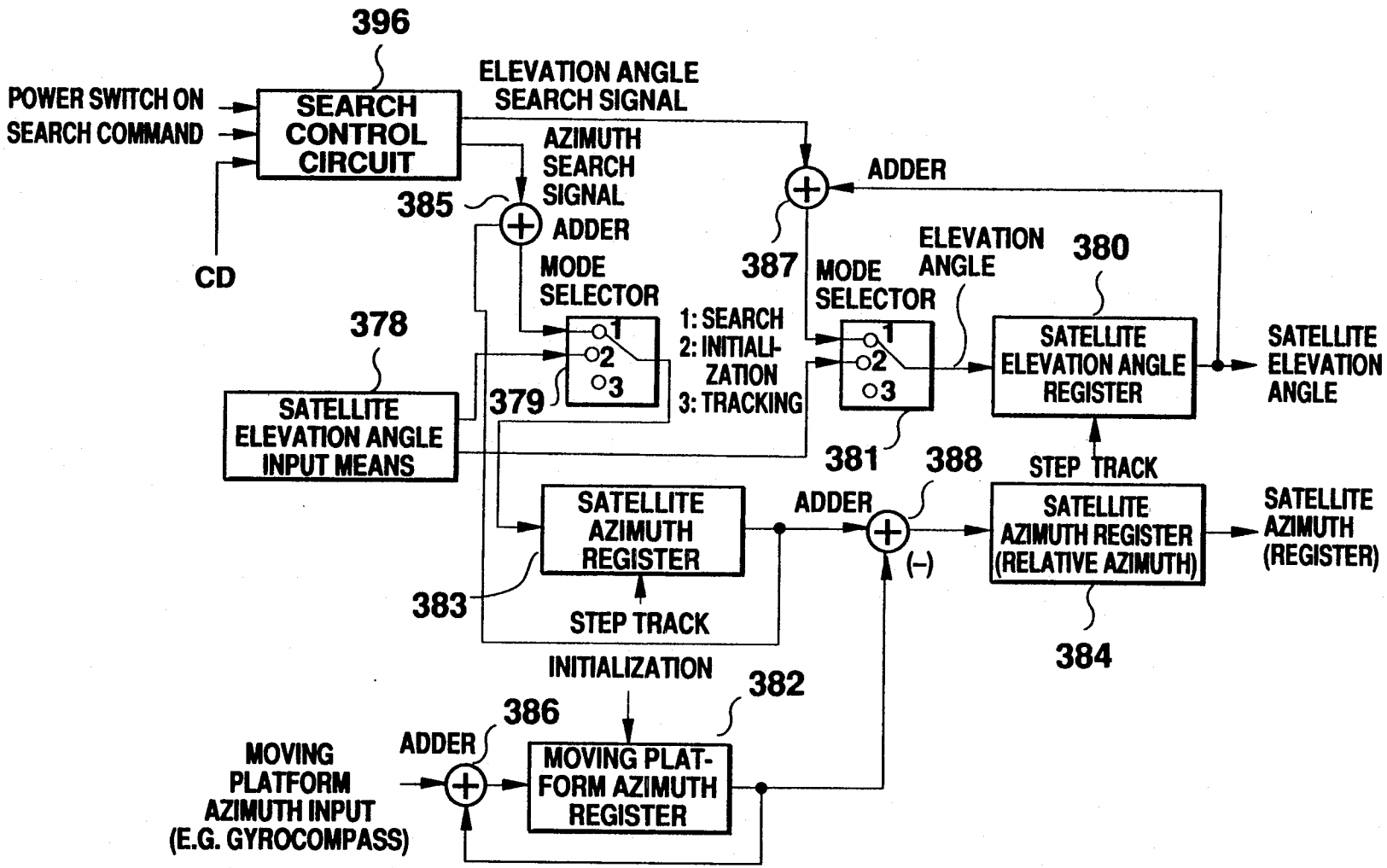
FIG. 14 is a block diagram showing the configuration of an azimuth & elevation angle input unit in a stabilized antenna system according to a third embodiment of this invention.

FIG. 14 shows the circuit configuration of an azimuth & elevation angle input unit of an antenna system according to a third embodiment of the invention. The antenna system of this embodiment differs from those of the first and second embodiments in this azimuth & elevation angle input unit.

The azimuth & elevation angle input unit includes a satellite azimuth and elevation angle input means 378 such as a GPS terminal or a keyboard similarly to the azimuth & elevation angle input unit of the first embodiment. One output end of this input means 378 is connected to a satellite elevation angle register 380 via a mode selector 381, and the other output end of the means 378 is connected to a satellite azimuth register 384 via a mode selector 379. The satellite azimuth register 383 is connected to a satellite azimuth register 384 via an adder 388. Step tracking is performed for the satellite elevation angle register 380 and the satellite azimuth register 383, if necessary. A moving platform azimuth register 382 is connected to the adder 388. An adder 386 is disposed in front of the moving platform azimuth register 382 to update the contents of the register 382. When both the mode selectors 379, 381 are set to the position "2", the circuit shown in FIG. 14 functions similarly to the circuit shown in FIG. 9. Step tracking is performed for the satellite azimuth register 383 instead of the moving platform azimuth register 382 to effect the operation described below when the mode selectors 379, 381 are set to the position "1".

The circuit shown in FIG. 14 includes a search control circuit 396 and is similar to the circuit of the second embodiment shown in FIG. 12. In the third embodiment, the search control circuit 396 outputs an azimuth search signal and an elevation angle search signal. The azimuth search signal is supplied to the satellite azimuth register 383 via the adder 385 and the mode selector 379. The elevation angle search signal is supplied to the satellite elevation angle register 380 via the adder 387 and the mode selector 381. The contents of the registers 383 and 380 are outputted to the adder 385 or 387. Therefore, when both the mode selectors 379, 381 are set to the position "1" in this embodiment, the output of the search control circuit 396 is added to the contents of the registers 383, 380 to update their contents.

Operation of the azimuth & elevation angle input unit of this embodiment will now be described. When the power supply is turned on and a search command is issued, a satellite is searched similarly as described with reference to the second embodiment. When it is triggered, the search control circuit 396 generates the azimuth search signal and the elevation angle search signal. In this case, it is assumed that the mode selectors 379, 381 have been set to the position "1" when the search control circuit 396 is triggered. Then, the azimuth search signal and the elevation angle search signal are added to the contents of the satellite azimuth register 383 or the satellite elevation angle register 380, so that the contents of the register 383 or 380 are exchanged by the added contents.

The contents of the satellite azimuth register 383 are a value representing the absolute azimuth of the satellite, and the contents of the satellite elevation angle register 380 are a value representing the elevation angle of the satellite. The contents of the moving platform azimuth register 382 (i.e. azimuth of the moving platform) are deducted from the former value to determine the relative azimuth of the satellite. The relative azimuth of the satellite is stored in the satellite azimuth register 384. Control variables are calculated based on the contents of the registers 384, 380, and the amount of the inclination of the moving platform. The calculated control variables are used to change the directions of the antenna and beams.

The contents of the satellite azimuth register 383 and the satellite elevation angle register 380 are updated by the output of the adder 380 or 387 to change the receiving output of the antenna. When a receiving condition becomes improved, CD changes to a value showing that state. The search control circuit 396 repeats outputting the azimuth search signals and the elevation angle search signals until CD value becomes optimum. Further, the mode selectors 379, 381 remain locked at the position "1".

Therefore, when the mode selectors are set at the position "1", the antenna is searching the satellite to catch it.

The mode selectors 379, 381 are set to "2" when initial seizure of the satellite is performed by using the azimuth & elevation angle input means 378 such as GPS. In this case, one of the outputs of the azimuth & elevation angle input means 378 is stored as the elevation angle of the satellite in the satellite elevation angle register 380. The other output of the azimuth & elevation angle input means 378 is stored as the absolute azimuth in the satellite azimuth register, as done with the first embodiment. The stored values are processed similarly to those with the first embodiment.

The mode selectors 379, 381 are set to "3" when no searching or initial seizure of the satellite is necessary. In this case, the contents of the satellite azimuth register 383 and the satellite elevation angle register 380 are not updated. Under this condition, relatively gentle variations of the azimuth and elevation angle of the satellite (e.g. variation in response to the motion of the moving platform) are compensated by the step tracking while relatively abrupt variations (e.g. turning or of the moving platform) are compensated by the output of the detection means.

The antenna system of the third embodiment can perform the functions of both the functions of the antenna systems of the first and second embodiments. Further, satellite tracking can be carried out by the step tracking if necessary. Data can be inputted by the keyboard.

Figure 15:
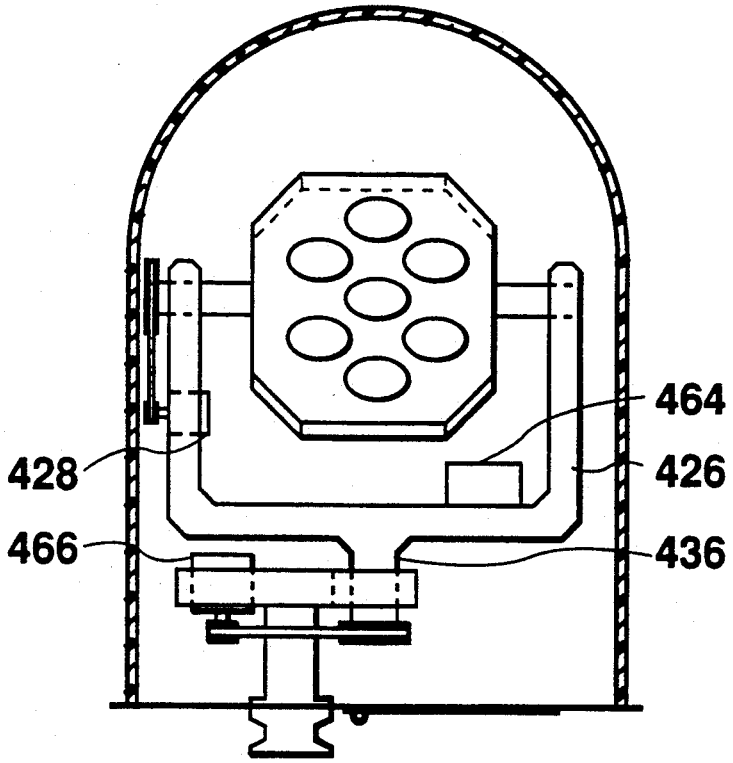
FIG. 15 is a side cross-sectional view of an antenna system according to a fourth embodiment.

The structure of the antenna system of the fourth embodiment is shown in FIG. 15 in cross-section. As shown in FIG. 15, an inclination detecting means 464 is mounted on the azimuth axis frame 426. When the azimuth axis 436 is angularly moved by the AZ axis motor 466, the inclination detecting means 464 is also moved angularly.

Figure 16:
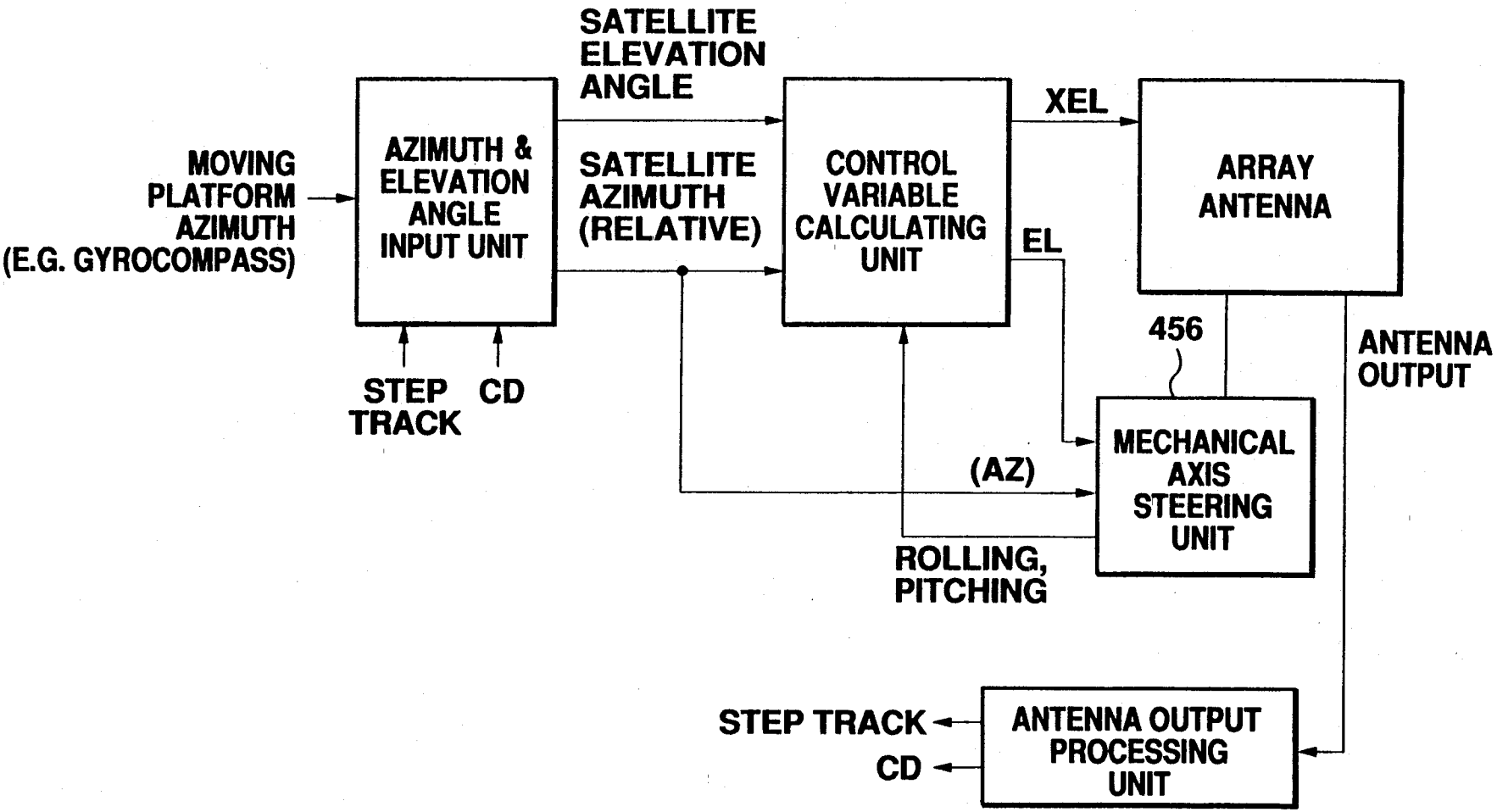
FIG. 16 is a block diagram showing the overall circuit configuration of the antenna system of the fourth embodiment.

FIG. 16 shows the overall circuit configuration of the antenna system of the fourth embodiment. This antenna system is similar to that of the third embodiment except that the detection means 464 is included in the mechanical axis steering unit 456.

Figure 17:
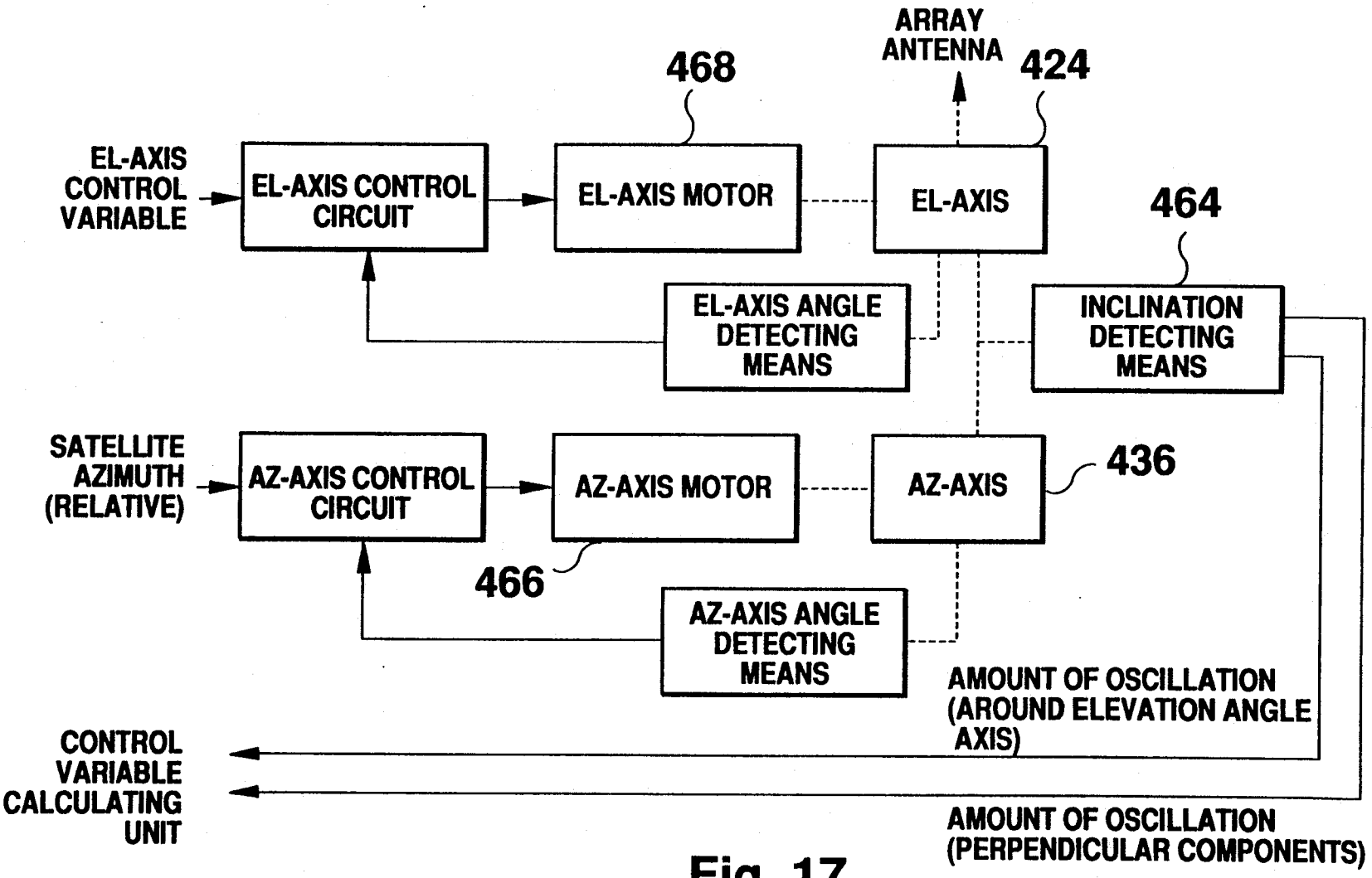
FIG. 17 is a block diagram showing a mechanical axis steering unit of the fourth embodiment.

The configuration of the mechanical axis steering unit 456 is shown in FIG. 17. The inclination detecting means 464 is included in the mechanical axis steering unit 456. The inclination detecting means 464 detects inclination of the two axes, and is arranged to detect inclination around the EL axis 424 and inclination around an axis perpendicular to the EL axis 424 and in the XY plane.

In the first to third embodiments, the control variables are calculated based on the elevation angle and azimuth of the satellite and the amount of inclination of the moving platform. With the fourth embodiment, the contents of the amount of inclination of the moving platform differ from those of the first to third embodiments. Specifically, in the first to third embodiment, the amount of inclination of the moving platform is the value obtained by the inclination detecting means 474 fixedly mounted on the moving platform. On the contrary, in the fourth embodiment, the amount of inclination of the moving platform is the value obtained by the inclination detecting means 474 fixedly mounted on the azimuth axis 436. The latter value does not include the inclination of the moving platform around the azimuth axis 436 of the antenna. Therefore, the matrix calculation mentioned above is not necessary. The following simple formula is enough for this embodiment.

$$\xi = q_2 f(el) \text{ [rad]}$$

$$\eta = \pi/2 - el + q_1 \text{ [rad]}$$

where el: an elevation angle with reference to the zenith; $q_1$: inclinations around the EL axis 424; $q_2$: inclinations around the axis perpendicular to the EL axis and in the XY plane; and f(el): a function. Since the phase shifter is assumed to a digital phase shifter in this embodiment, $\xi$ should be a discrete value $\xi_j$ (j=1, 2, 3, . . . ). f(el) is a discritization function to meet the above requirement.

The following are conceivable as f(el).

i) Firstly, $\cos(\pi/2 - el)$ is calculated.

ii) Secondly, $\xi = q_2 \cos(\pi/2 - el)$ is calculated.

iii) A value which is nearest $\xi$ is selected from the discrete value $\xi_j$ (j=1, 2, 3, . . .).

iv) f(el) is determined from $f(el) = \xi_j / q_2$.

When the phase shifter is analogous, $f(el) = \cos(\pi/2 - el)$ is acceptable.

The control variables can be calculated very simply in this embodiment. Therefore, the antenna system can be realized less expensively. Specifically, it is not necessary to use a processor which can perform arithmetic floating point operation.

Although a gyrocompass is exemplified as an azimuth input unit in the foregoing description, the azimuth input unit is not limited to the gyrocompass. Further, the radome may be supported on a deck of a ship by a usual method, e.g. by using a post. The radome can be installed by the support disclosed in co-pending Japanese Utility Model Application No. HEI 2-89713.

The antenna elements are arranged in three columns in the foregoing embodiments. However, the number of columns is not limited to three. It is preferable that the number of columns is odd-number since a phase shifter associated with the central column can be omitted.

According to this invention, the distance between adjacent columns of antenna elements can be reduced, and the horizontal distance between adjacent antenna elements can also be reduced. Therefore, sidelobes can be suppressed, and the beam width can be increased. Further, since the number of necessary phase shifters is decreased, the array antenna can be manufactured less expensively.

The number of antenna elements per column is varied to suppress sidelobes further.

Since the antenna and its related components are supported on the radome bottom at a position eccentric from the center thereof, a space for the access hutch can be obtained to facilitate maintenance work.

Stabilization of the antenna system can be performed by controlling only the EL and XEL axes.

The 2-axis inclination detecting means can be disposed to be movable with the AZ axis, thereby simplifying the arithmetic operation for the antenna stabilization.

What is claimed is:

1. A stabilized antenna system to be installed on a moving platform, comprising:

(a) an array antenna comprising:

an antenna including a plurality of antenna elements arranged in N columns, wherein N is an odd number being at least 3 so that the antenna elements belonging to each column for adjacent columns are arranged in a staggered manner, and wherein the number of said antenna elements is largest in a central column and is least in peripheral columns;

an elevational axis for supporting the antenna being pivotable; said columns of antenna elements being arranged along said elevational axis;

an azimuth axis for supporting the antenna and the elevation axis being pivotable; said azimuth axis and said elevation axis being perpendicular and parallel to the deck of a moving platform respectively; and a plurality of variable phase shifters corresponding to each one of N−1 columns of the antenna elements for performing phase-shift of signals transmitted from and received by the antenna elements belonging to the corresponding peripheral columns;

(b) satellite data input means for determining an elevation angle and a relative azimuth of a satellite;

(c) inclination detecting means for detecting an amount of inclination of a moving platform;

(d) an azimuth axis motor for driving said azimuth axis;

(e) an elevation axis motor for driving said elevation axis;

(f) azimuth axis control means for designating said azimuth motor an angle of movement of said azimuth axis based on the relative azimuth of the satellite;

(g) elevation axis control means for designating said elevation axis motor an angle of movement according the elevation angle and the relative azimuth of the satellite, and an amount of inclination of the moving platform; and (h) electronic cross-elevation axis control means for determining a control variable of said phase shifters based on the elevation angle and relative azimuth of the satellite and an amount of inclination of the moving platform, and designating determined control variable to said phase shifters.

2. A stabilized antenna according to claim 1 wherein the antenna elements are arranged in a rectangular like area with the antenna being longer in the vertical direction than it is in the horizontal direction.

3. An antenna system according to claim 1, wherein said array antenna further including: a radome for covering at least said antenna, said elevation axis and said azimuth axis; a radome base for placing said radome on; means for supporting said antenna, said elevation axis and said azimuth axis on said radome base at a position eccentric from a central portion of said radome base; and an access hutch located on said radome base to serve as a door.

4. An antenna system according to claim 1, wherein said array antenna further including: a radome for covering at least said antenna, said elevation axis and said azimuth axis; a radome base for placing said radome on; means for supporting said antenna, said elevation axis and said azimuth axis on said radome base at a position eccentric from a central portion of said radome base; and an access hutch located on said radome base to serve as a door.

5. An antenna system according to claim 1, wherein said inclination detecting means includes two-axis inclination detecting means disposed to be angularly movable according to the movement of said azimuth axis. said two-axis inclination detecting means detecting inclination of the moving platform around said elevation axis and inclination around a hypothetical axis perpendicular to said elevation axis.

6. An antenna system according to claim 1, wherein said inclination detecting means includes two-axis inclination detecting means disposed to be angularly movable according to the movement of said azimuth axis, said two-axis inclination detecting means detecting inclination of the moving platform around said elevation axis and inclination around a hypothetical axis perpendicular to said elevation axis.

7. An antenna system according to claim 3, wherein said inclination detecting means includes two-axis inclination detecting means disposed to be angularly movable according to the movement of said azimuth axis, said two-axis inclination detecting means detecting inclination of the moving platform around said elevation axis and inclination around a hypothetical axis perpendicular to said elevation axis.

8. An antenna system according to claim 4, wherein said inclination detecting means includes two-axis inclination detecting means disposed to be angularly movable according to the movement of said azimuth axis, said two-axis inclination detecting means detecting inclination of the moving platform around said elevation axis and inclination around a hypothetical axis perpendicular to said elevation axis.

9. A stabilized antenna system according to claim 1 wherein a horizontal distance between adjacent antenna elements is less than 0.6 wavelengths at the operating frequency.

* * * * *